US010982936B2

(12) United States Patent
Lumley

(10) Patent No.: US 10,982,936 B2
(45) Date of Patent: Apr. 20, 2021

(54) LINEAR SHAPED CHARGE SUPPORT STRUCTURE

(71) Applicant: LINEAR SHAPED LIMITED, Hartlepool (GB)

(72) Inventor: Andrew Lumley, Alston (GB)

(73) Assignee: LINEAR SHAPED LIMITED, Hartlepool (GB)

( * ) Notice: Subject to any disclaimer, the term of this patent is extended or adjusted under 35 U.S.C. 154(b) by 0 days.

(21) Appl. No.: 16/104,475

(22) Filed: Aug. 17, 2018

(65) Prior Publication Data

US 2019/0072368 A1 Mar. 7, 2019

Related U.S. Application Data

(63) Continuation of application No. PCT/GB2017/050422, filed on Feb. 17, 2017.

(30) Foreign Application Priority Data

Feb. 18, 2016 (GB) ..... 1602887

(51) Int. Cl.

| | |
|---|---|
| ***F42B 3/087*** | (2006.01) |
| ***F42B 1/028*** | (2006.01) |
| ***F42B 3/08*** | (2006.01) |
| ***F42D 3/00*** | (2006.01) |
| ***F42B 3/02*** | (2006.01) |
| ***F42B 1/02*** | (2006.01) |

(52) U.S. Cl.

CPC ..... *F42B 1/028* (2013.01); *F42B 1/02* (2013.01); *F42B 3/02* (2013.01); *F42B 3/08* (2013.01); *F42B 3/087* (2013.01); *F42D 3/00* (2013.01)

(58) Field of Classification Search

CPC .. F42B 1/02; F42B 1/028; F42B 1/032; F42B 3/08; F42B 3/02; F42B 3/087; F42D 3/00

USPC ..... 102/305, 306, 307, 308, 309, 310, 476, 102/331, 332; 89/1.14, 1.15

See application file for complete search history.

(56) References Cited

U.S. PATENT DOCUMENTS

| | | | | |
|---|---|---|---|---|
| 2,587,243 A | | 2/1952 | Sweetman | |
| 3,712,221 A | * | 1/1973 | Voigt, Jr. | F42D 5/045 89/1.14 |
| 3,838,643 A | | 10/1974 | Austin et al. | |
| 4,354,433 A | * | 10/1982 | Owen | B26F 3/04 102/307 |

(Continued)

FOREIGN PATENT DOCUMENTS

EP 2036685 A1 3/2009

OTHER PUBLICATIONS

GB Search Report dated Oct. 19, 2016 for GB Application No. GB1602887.0.

(Continued)

*Primary Examiner* — Jonathan C Weber
(74) *Attorney, Agent, or Firm* — EIP US LLP

(57) ABSTRACT

Examples relate to a linear shaped charge support structure configured to support a linear shaped charge in a canted configuration with at least part of the linear shaped charge canted about a longitudinal axis of the linear shaped charge. Examples relates to a linear shaped charge, the linear shaped charge support structure comprising a linear shaped charge, and a support frame comprising the linear shaped charge support structure and a non-linear shaped charge support structure.

7 Claims, 9 Drawing Sheets

(56) References Cited

U.S. PATENT DOCUMENTS

| | | | | |
|---|---|---|---|---|
| 4,856,430 | A * | 8/1989 | Gibb | F42B 3/08 102/307 |
| 4,905,601 | A | 3/1990 | Gabriel | |
| 7,536,956 | B2 * | 5/2009 | Sammons | C06B 45/00 102/306 |
| 8,904,934 | B1 | 12/2014 | Scheid | |
| 8,904,935 | B1 * | 12/2014 | Brown | F42B 3/08 102/310 |
| 8,978,558 | B2 * | 3/2015 | Lumley | F42B 1/036 102/307 |
| 9,045,692 | B2 * | 6/2015 | Lumley | C10B 49/10 |
| 2005/0126420 | A1 * | 6/2005 | Givens | F42B 1/02 102/310 |
| 2006/0201373 | A1 * | 9/2006 | Sammons | C06B 45/00 102/476 |
| 2013/0014661 | A1 * | 1/2013 | Lumley | F42B 1/032 102/307 |
| 2013/0014662 | A1 | 1/2013 | Lumley | |
| 2013/0014663 | A1 * | 1/2013 | Lumley | F42B 1/036 102/309 |

OTHER PUBLICATIONS

International Search Report and Written Opinion dated May 17, 2017 for PCT Application No. PCT/GB2017/050422.

* cited by examiner

LINEAR SHAPED CHARGE SUPPORT STRUCTURE

CROSS-REFERENCE TO RELATED APPLICATIONS

This application is a continuation of International Application No. PCT/GB2017/050422, filed Feb. 17, 2017, claims priority to GB Application No. 1602887.0, filed Feb. 18, 2016, under 35 U.S.C. § 119(a). Each of the above-referenced patent applications is incorporated by reference in its entirety.

BACKGROUND OF THE INVENTION

Linear shaped charges may be used to precisely cut structures, for example metal structures such as a hull of a ship, a fuselage of an aircraft, or a structural support. It is often desirable to use linear shaped charges to breach walls, such as those made of concrete which may be reinforced. Reinforced concrete usually comprises a reinforcement structure, such as a steel grid, embedded within the concrete. Thus, to breach a wall of this type the linear shaped charge must cut through both concrete and a steel structure within. This is a difficult task for a linear shaped charge due for example to the nature of the concrete and steel materials.

It is desirable to improve cutting of, for example, targets of a reinforced concrete material using a linear shaped charge.

DETAILED DESCRIPTION OF CERTAIN INVENTIVE EMBODIMENTS

It has been found through trials and experiments that when breaching a structure, such as a wall, for people to pass through, rectangular cut-outs or so-called manholes are more efficient than rounded manholes in terms of the number of bodies that can pass through the manhole in a given time. Trials and experiments have shown that squarer breach openings facilitate most rapid ingress and egress through such an opening, thus minimising the time on a target for the breacher. It is therefore desirable to utilise the precision of linear shaped charges to cut substantially rectangular, or square, manholes out of target structures or objects made of materials such as reinforced concrete.

In order to do this, corner joints are often required. It is understood that subjecting a linear shaped charge to asymmetry, for example via lateral bending, can reduce the cutting performance of that linear shaped charge. The minimum bend radius characteristic of a linear shaped charge (which may be considered the minimum planar bending that a linear shaped charge can experience without sufficiently degrading performance of the cutting jet emitted by the charge upon detonation) also limits acute bending of a flexible linear shaped charge. Even linear shaped charges with geometries that resist performance degradation have a limit where over bending to form a square can degrade performance to a point where no cutting results at all.

Therefore, practically, more than one linear shaped charge can be used to perform a square corner cut in a material. However, there are limitations on the kinds of joints that are applicable to joining two linear shaped charge ends at a corner. For example, symmetry is required for liner collapse upon detonation, and so mitre joints do not work. Jet performance must usually also be sufficient to cut through the target material, and so joints such as a pyramid mitre, which overcomes the symmetry problem but has diminished performance, are not practically applicable.

It has now been realised that linear shaped charges can be used to cut a corner while preserving a sufficiently effective depth of penetration into the target, as will now be described in the following embodiments.

Figure 1A:
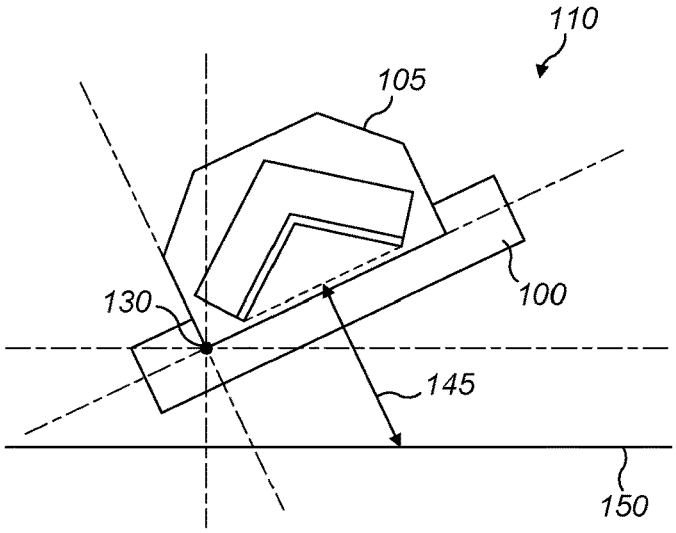
FIGS. 1*a*, 1*b* and 1*c* show schematically canting of a linear shaped charge according to embodiments.
Figure 1B:
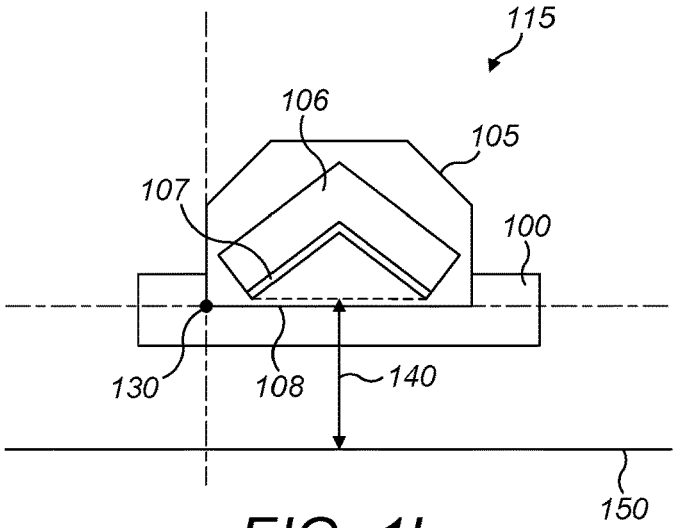
Figure 1C:
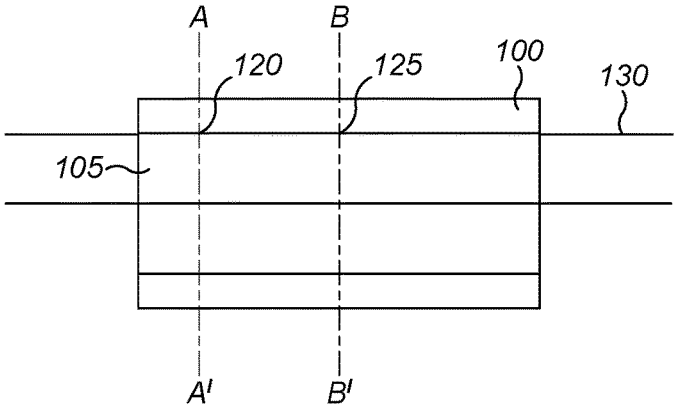

FIGS. 1*a*, 1*b* and 1*c* show a linear shaped charge support structure 100 configured to support a linear shaped charge 105 in a canted configuration. FIG. 1*a* shows a first cross section 110 of the linear shaped charge 105 supported by the linear shaped charge support structure 100. This first cross section 110 is canted relative to a second cross section 115 of the linear shaped charge 105, shown in FIG. 1*b*. FIG. 1*c* in plan view shows the linear shaped charge support structure 100 configured to support a linear shaped charge 105 in a canted configuration. The first cross section 110 is located at a first location 120 on a longitudinal axis 130 of the linear shaped charge. This cross section is labelled as a plane through AA' in FIG. 1*c*. The second cross section 115 is located at a second location 125 on the longitudinal axis 130. This cross section is labelled as a plane through BB' in FIG. 1*c*. In this embodiment the canting is a rotation relative to the longitudinal axis 130. In further embodiments the canting may be a rotation relative to, for example, a different longitudinal axis which may run along or parallel to a longitudinal dimension of the linear shaped charge.

Canting is for example considered to be a twisting, tilting, banking, and/or rotating. A linear shaped charge may be considered to be in a canted configuration with at least part of the linear shaped charge canted about a longitudinal axis of the linear shaped charge. Thus, a linear shaped charge support structure in examples described herein is configured such that, when a linear shaped charge is mounted on the linear shaped charge support structure, at least part of the linear shaped charge is supported or held in a canted configuration, as described by the various examples herein, and illustrated for example with FIGS. 1*a* to 1*c*, 6*b* and 6*c*. It is to be appreciated that in examples described herein of a linear shaped charge support structure configured to support a linear shaped charge in a canted configuration, for example according to FIGS. 1*a* to 1*c*, further similar examples are envisaged, with appropriate modifications, with at least one linear shaped charge instead canted as described with reference to FIG. 6*b*.

Figure 2A:
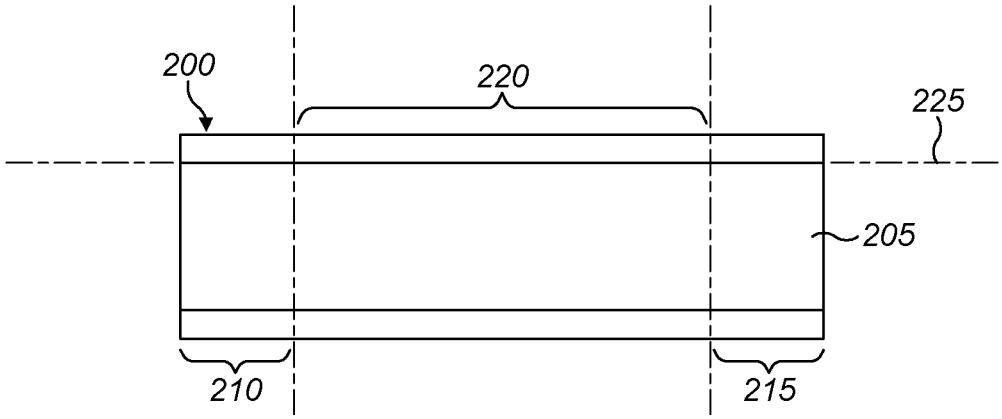
FIGS. 2*a*, 2*b* and 2*c* show schematically views of linear shaped charge support structures according to embodiments.
Figure 2B:
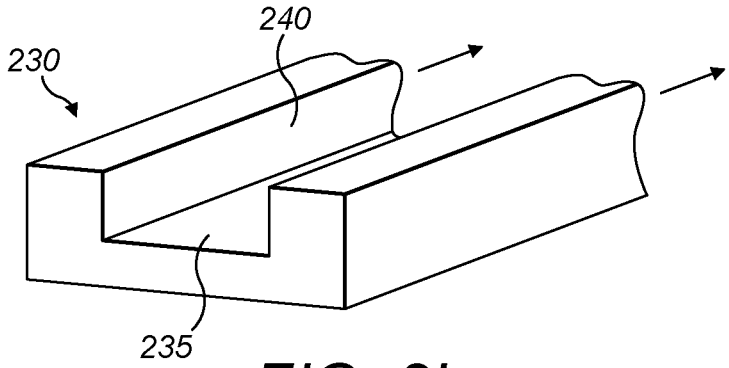
Figure 2C:
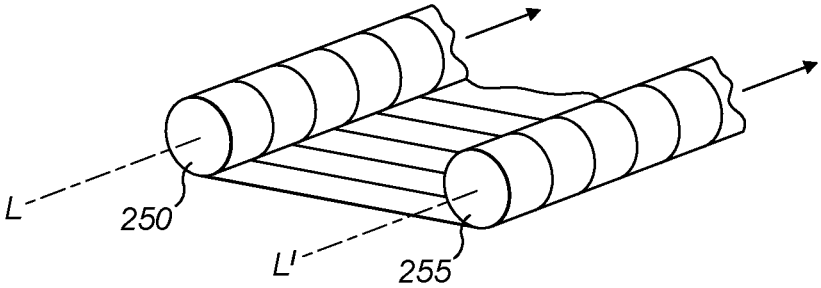

In some embodiments the linear shaped charge in a canted configuration comprises a central portion and end portions, as shown for example in FIG. 2*a*, where the linear shaped charge support structure 200 is configured to support a linear shaped charge 205 in the canted configuration. In embodiments, one of a first end 210 or a second end 215 is canted with respect to a central portion 220 of the linear shaped charge 205. This canting may be a torsional rotation or twisting of the end 210 or 215 about a longitudinal axis of the linear shaped charge 205, for example the axis 225 shown in FIG. 2*a*. In embodiments, this canting may be a rotation or tilting of the end 210 or 215 about a longitudinal axis running along a longitudinal surface of the linear shaped charge 205. The canting may comprise twisting, tilting, and/or banking about any longitudinal axis of the linear shaped charge 205, or the linear shaped charge support structure 200. In some embodiments, both ends 210 and 215 are canted with respect to the central portion 220. This canting may be different for each end, or the same for both ends. For example, the ends 210 and 215 may be canted about different longitudinal axes. The ends 210 and 215 may also be canted by different amounts, for example rotated by different angles, in the same or different rotational directions, with respect to the same or different longitudinal axes. In some embodiments, both ends 210 and 215 are canted by substantially the same angle (e.g. within acceptable measuring tolerances), in the same rotational direction with respect to the same longitudinal axis. The shorter the end portions 210, 215 that are canted with respect to the central portion 220, the higher may be the average penetration of the jet into the target. For example, if a longitudinal surface of the central portion 220 for contacting a target object is coplanar with a target surface of the target object, a jet formed by the linear shaped charge in this central portion 220 propagates perpendicularly towards the target surface. This is typically the most efficient orientation of a linear jet relative to a target surface, as the largest component possible of propagating energy is directed perpendicularly into the target object to achieve the deepest penetration possible for a given amount of jet energy. A linear shaped charge which has been canted with respect to this orthogonal configuration, however, produces a jet which is also canted and thus does not travel perpendicularly into the target surface. Such a canted jet thus may have a lower component of energy acting perpendicularly into the target object, and penetration is therefore less deep compared to purely perpendicular propagation for a given jet energy. Therefore, the larger the proportion of the linear shaped charge which has a face for application to a target object, or support structure, in a parallel plane to the target surface plane, the deeper the average penetration of the target object. Shortening the proportion of the end(s) which is/are canted can therefore increase average penetration depth.

The linear shaped charge support structure 100, 200 may be made from material such as fibre glass, plastic polymer (e.g. polyvinyl chloride), thermoplastic polymer (e.g. Acrylonitrile-Butadiene-Styrene), aluminum, or other such suitable structural material. The linear shaped charge support structure 100, 200 may have any structural composition or configuration suitable for supporting a linear shaped charge in a canted configuration. For example, in an embodiment, the support structure 100, 200 comprises a mesh which may be shaped to support the linear shaped charge 105, 205. The mesh may guide or shape the linear shaped charge 105, 205 into a canted configuration.

In embodiments, the support structure 100, 200 comprises a track 230 for supporting the linear shaped charge 105, 205. This track may support the linear shaped charge 105, 205 along a longitudinal surface of the linear shaped charge. The track may comprise a guide, a rail, a path or other such structure for supporting the linear shaped charge 105, 205. The track may be comprised of one or more parts, which may contact the linear shaped charge 105, 205 at one or more points along the longitudinal surface of the linear shaped charge. In embodiments, the track comprises a longitudinal track surface 235 for contacting the longitudinal surface of the linear shaped charge 105, 205. In other embodiments, the longitudinal track surface comprises a slot extending along at least part of a longitudinal axis of the track, through which slot the jet may pass unhindered by the support structure. In embodiments, the track comprises two or more longitudinal track surfaces 235, 240 for contacting two or more longitudinal surfaces of the linear shaped charge 105, 205.

In other embodiments, the support structure 100, 200 comprises at least two substantially parallel rails 250, 255 for contacting the linear shaped charge 105, 205. Substantially parallel means that the rails need not be perfectly parallel, e.g. maintain a constant distance between them continuously along their length; only intersecting at an infinite distance. They should be parallel enough to perform the function of supporting the linear shaped charge 105, 205 along a longitudinal surface of the linear shaped charge; the distance between the rails may vary along the length of the rails. In embodiments, the angle between any two of the longitudinal axes L, L' of the two or more substantially parallel rails 250, 255 is less than 20 degrees, and for example less than 10 degrees.

In other embodiments, the support structure 100, 200 comprises a liner which is used for forming the linear shaped charge 105, 205 in a canted configuration. The liner may be flexible or preformed in a canted configuration and of a suitably rigid or non-flexible material to hold the pre-formed canted configuration. In some other embodiments though the material may also have some degree of flexibility to enable deformation to the desired canted configuration, for example by a human without tools. In such embodiments, a liner of a linear shaped charge may be integrated in the support structure itself. For example, the support structure may be a pre-formed liner for a linear shaped charge which may be pre-formed with the canted configuration. Thus, explosive material may be applied in situ to the liner, to form in situ the linear shaped charge with the canted configuration. Such a liner may have a similar structure as that described elsewhere for a linear shaped charge. For example, the liner of the support structure may be formed of a suitable liner material, for example copper, an alloy thereof, or a polymer comprising copper or other metal particles densely distributed therein, and having a longitudinal element with a V-shaped cross section. Such a liner may be referred to elsewhere herein as a linear liner, being a liner for a linear shaped charge. With such a liner being canted, the orientation of the V-shaped cross section at one location on the longitudinal axis is canted relative to the orientation of the V-shaped cross section at a different location on the longitudinal axis.

In further embodiments, the support structure 100, 200 comprises a guide for a liner, for example made out of plastic or other material, for a flexible liner material to be positioned onto the guide and shaped into a liner for forming the linear shaped charge 105, 205 in a canted configuration. The guide comprises a canted configuration desired for the linear shaped charge, and so the liner of the formed linear shaped charge inherits the canted configuration of the guide for the liner.

The linear shaped charge support structure 100, 200 may be pre-formed in a canted configuration, for example with torsional twisting or canting of a portion along a longitudinal axis of the support structure, such that a cross section of this portion is canted with respect to another portion along the same longitudinal axis. Such a structure may be rigid or sufficiently non-flexible to hold the pre-formed canted configuration. Thus, the linear shaped charge support structure 100, 200 may be positioned to support a flexible linear shaped charge 105, 205. In this and similar embodiments, the flexible linear shaped charge 105, 205 assumes the canted configuration of the pre-formed linear shaped charge support structure 100, 200. In other embodiments, the linear shaped charge support structure 100, 200 is malleable and plastically deformable, such that it may be positioned into the canted configuration as described above and hold this canted configuration after deformation to the canted configuration.

Figure 3A:
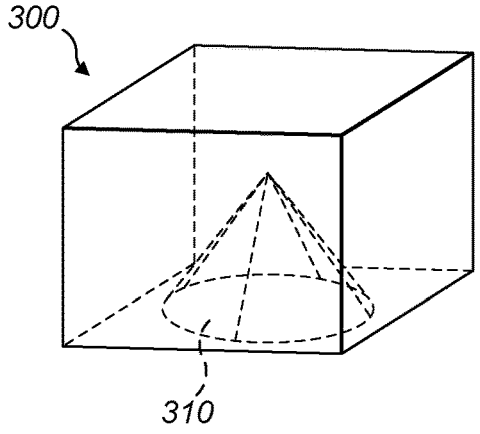
FIGS. 3*a*, 3*b*, 3*c* and 3*d* show schematically non-linear shaped charge support structures according to embodiments.
Figure 3B:
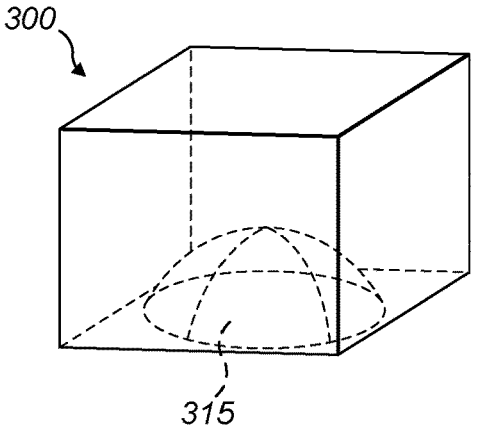

FIGS. 3*a*, 3*b*, 3*c* and 3*d* show embodiments of a non-linear shaped charge support structure 300 configured to support a non-linear shaped charge. In some embodiments, the non-linear shaped charge supported by the structure 300 may be selected from a group consisting of: a conical charge (an example of which is shown in FIG. 3*a*); an explosively formed penetrator (EFP) charge (an example of which is shown in FIG. 3*b*); and a contact charge (which is for example a charge formed of explosive material placed directly on or close to a target surface, without any liner or shaped liner). In embodiments, the non-linear shaped charge support structure 300 is configured to support a non-linear shaped charge comprising a conical liner 310 (FIG. 3*a*). In other embodiments, the non-linear shaped charge support structure 300 is configured to support a non-linear shaped charge comprising a concave liner 315 (FIG. 3*b*). This concave liner 315 may have a shallow dish shape to form an explosive projectile on detonation, for example it may be comprised as part of an explosively formed penetrator/projectile (EFP) charge as will be understood by the skilled person. In embodiments where the non-linear shaped charge support structure 300 is configured to support a non-linear shaped charge, the support structure 300 may have attachment means for receiving the non-linear shaped charge, for example brackets, slots, or other fixations. In other embodiments, the support structure comprises a housing or casing for receiving and supporting the non-linear shaped charge.

In some embodiments, the non-linear shaped charge support structure 300 comprises a liner for a non-linear shaped charge. In embodiments, the liner for the non-linear shaped charge has a conical shape. In other embodiments, the liner for the non-linear shaped charge has a concave shape. In some examples of these latter embodiments, the liner has a concave dish shape and may be a liner for an EFP charge. Thus, the non-linear shaped charge may be formed in situ, in its support structure 300, in some examples.

Figure 3C:
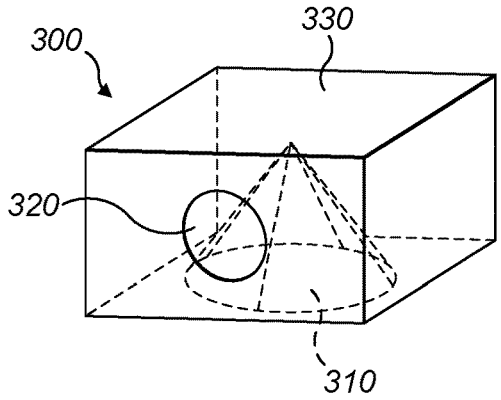

FIG. 3*c* shows an embodiment where the non-linear shaped charge support structure 300 comprises an aperture 320 and explosive material 330 packed within the support structure. The explosive material 330 may therefore be exposed through the aperture 320. There may be more than one such aperture, for the explosive material to contact more than one linear shaped charge.

Figure 3D:
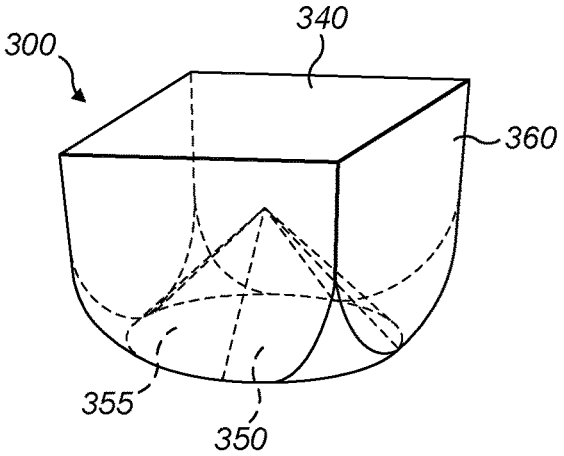

FIG. 3*d* shows an example of an embodiment wherein the non-linear shaped charge support structure 300 comprises a rectangular or square face 340 longitudinally opposite a rounded or circular face 350. The circular face 350 is for application to a target, and the circular outline may correspond with a supported non-linear shaped liner 355, such as a conical or EFP liner. The faces 360 of such an embodiment of the non-linear shaped charge support structure 300 therefore have a larger cross sectional area than a cylindrical non-linear shaped charge support structure with the same conical, EFP or simple rounded contact liner. This may be useful when positioning a linear shaped charge with an end face abutting the non-linear shaped charge support structure 300, as a larger amount of intimate contact may be achieved between the end face of the linear shaped charge and the face 360 of the non-linear shaped charge support structure 300, more specifically between explosive material of the non-linear shaped charge supported by the structure and explosive material of the linear shaped charge.

In some embodiments, the non-linear charge support structure 300 is configured to support a linear shaped charge arranged in an annular configuration. In these embodiments the linear shaped charge supported by the non-linear charge support structure 300 is not configured to cut a line with end points that are laterally displaced in a plane. Instead, the start and end points of the linear shaped charge, and therefore of the resulting cut, are at the same location. In such an embodiment, with annular angling of the jet of the linear shaped charge, more energy may propagate laterally through the target object and along the target surface than when a conical, EFP or contact charge is supported by the non-linear charge support structure 300 and detonated.

Figure 4:
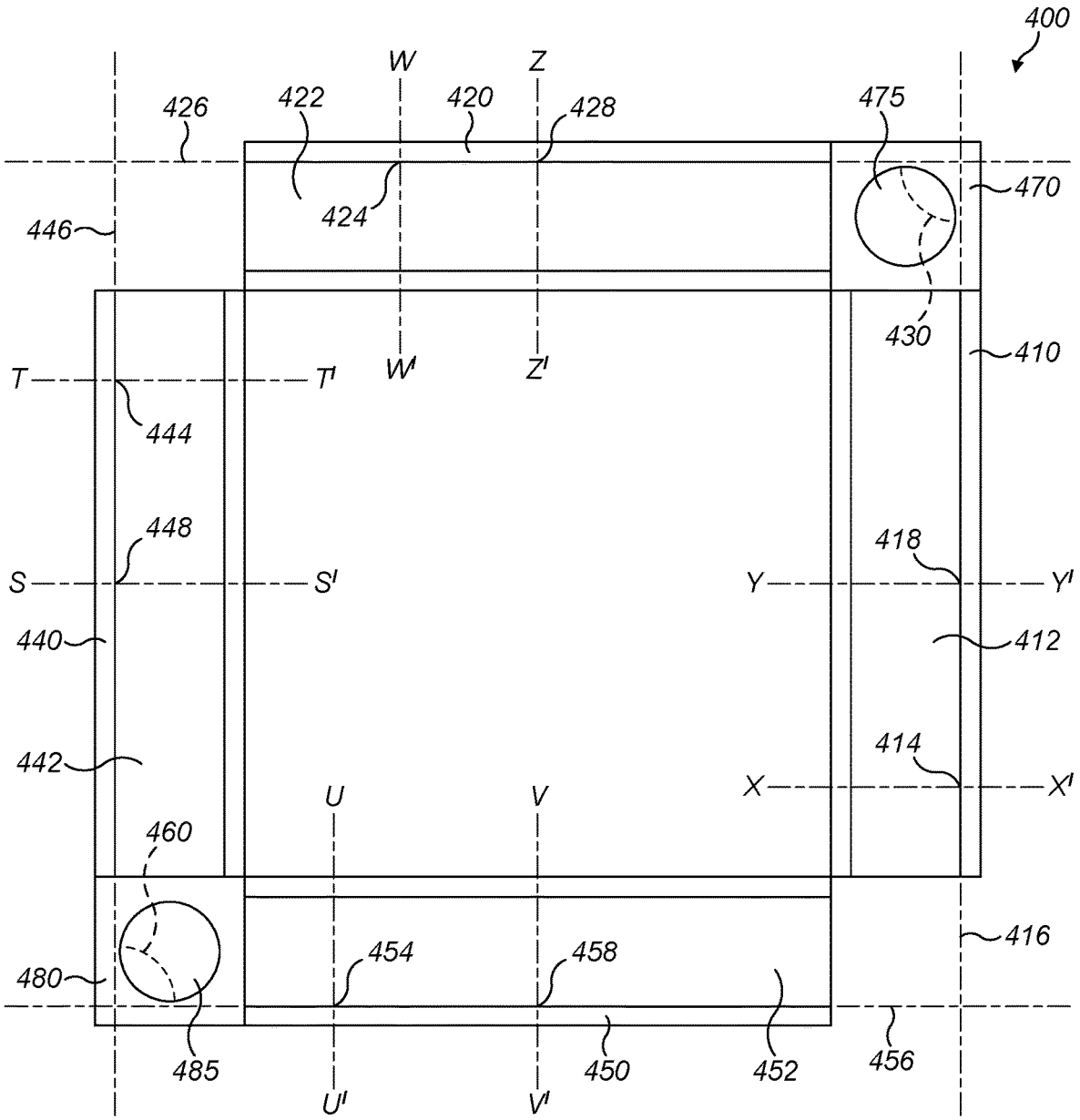
FIG. 4 shows schematically in plan view a shaped charge support frame according to embodiments.

FIG. 4 shows a shaped charge support frame 400, which may be considered a support frame that can support a shaped charge. The shaped charge support frame 400 comprises a first linear shaped charge support structure 410 configured to support a first linear shaped charge 412 in a canted configuration. The canted configuration of the first linear shaped charge 412 is as described above with respect to FIG. 1. A first cross section of the first linear shaped charge 412 is canted relative to a second cross section of the first linear shaped charge. The first cross section is located at a first location 414 on a first longitudinal axis 416 of the first linear shaped charge. This is shown as a slice through XX'. The second cross section is located at a second location 418 on the first longitudinal axis 416. This is shown as a slice through YY'. In some embodiments, the shaped charge support frame comprises a second linear shaped charge support structure 420 configured to support a second linear shaped charge 422 comprising a second longitudinal axis 426. Any of the support structures described in relation to FIG. 4 may be in accordance with the support structure embodiments described above or below.

In some embodiments, a third cross section is canted relative to a fourth cross section of the second linear shaped charge 422, as described above with reference to FIG. 1. The third cross section is located at a third location 424 on the second longitudinal axis 426. This is shown as a slice through WW'. The second cross section is located at a fourth location 428 on the second longitudinal axis 426. This is shown as a slice through ZZ'.

In the above embodiments, cross sectional slices XX' and WW' may correspond to AA', and YY' and ZZ' may correspond to BB' when referencing FIG. 1 for the canted configuration of the first and/or second linear shaped charges; 412 and 422 in FIG. 4.

In embodiments of the shaped charge support frame 400, the first longitudinal axis 416 and the second longitudinal axis 426 lie in a common plane. An internal angle 430 between the first longitudinal axis 416 and the second longitudinal axis 426 is substantially between 45 degrees and 135 degrees in the common plane, for example between 45 and 135 degrees measured within acceptable measuring tolerances, between 60 to 120 degrees, between 75 to 105 degrees, between 80 to 100 degrees, between 85 to 95 degrees, between 87.5 to 92.5 degrees, substantially 90 degrees within acceptable measuring tolerances, or 90 degrees. The nearer to 90 degrees, the more effective may be the cutting of a corner.

In embodiments of the shaped charge support frame 400, at least one of: the first linear shaped charge support structure 410 comprises a first linear liner for forming the first linear shaped charge; or the second linear shaped charge support structure 420 comprises a second linear liner for forming the second linear shaped charge. Either of such linear liners may be in accordance with the linear liner embodiments described above.

In embodiments, the shaped charge support frame 400 comprises a third linear shaped charge support structure 440 configured to support a third linear shaped charge 442 in a canted configuration. A fifth cross section of the third linear shaped charge 442 is canted relative to a sixth cross section of the third linear shaped charge 442. The fifth cross section is located at a fifth location 444 on a third longitudinal axis 446 of the third linear shaped charge 442. This is shown as a slice through TT'. The sixth cross section is located at a sixth location 448 on the third longitudinal axis 446. This is shown as a slice through SS'. In embodiments, the shaped charge support frame comprises a fourth linear shaped charge support structure 450 configured to support a fourth linear shaped charge 452 in a canted configuration. A seventh cross section is canted relative to an eighth cross section of the fourth linear shaped charge 452. The seventh cross section is located at a seventh location 454 on a fourth longitudinal axis 456 of the fourth linear shaped charge 452. This is shown as a slice through UU'. The eighth cross section is located at an eighth location 458 on the fourth longitudinal axis 456. This is shown as a slice through VV'.

In embodiments of the shaped charge support frame 400, the third longitudinal axis 446 and the fourth longitudinal axis 456 lie in a common plane. An angle 460 between the third longitudinal axis 446 and the fourth longitudinal axis 456 is substantially between 45 degrees and 135 degrees in the common plane, for example between 45 and 135 degrees measured within acceptable measuring tolerances, between 60 to 120 degrees, between 75 to 105 degrees, between 80 to 100 degrees, between 85 to 95 degrees, between 87.5 to 92.5 degrees, substantially 90 degrees within acceptable measuring tolerances, or 90 degrees.

In embodiments, the first linear shaped charge support structure 410, the second linear shaped charge support structure 420, the third linear shaped charge support structure 440 and the fourth linear shaped charge support structure 450 are arranged respectively at a first side, a second side, a third side and a fourth side of a parallelogram. This is shown in FIG. 4. In some examples, the parallelogram may have four interior right angles, forming a rectangle. In further embodiments, the parallelogram may have four interior right angles and the four linear shaped support structures 410, 420, 440, and 450 may be of equal length, forming a square arrangement. In further embodiments any one or all of the interior angles between two longitudinal axes may be in the range of between 45 and 135 degrees, or the sub-ranges within, as explained above.

In embodiments of the shaped charge support frame 400, a first non-linear shaped charge support structure 470, configured to support a first non-linear shaped charge 475, is arranged at a first corner of the parallelogram. This is shown in FIG. 4. In further embodiments, a second non-linear shaped charge support structure 480, configured to support a second non-linear shaped charge 485, is also arranged at a second corner of the parallelogram, where the second corner is diagonally opposite the first corner. This is also shown in FIG. 4. Such support structures may be as described according to embodiments above and below.

In embodiments, at least one of: the first non-linear shaped charge support structure 470; or the second non-linear shaped charge support structure 480; comprises explosive material and at least one aperture configured to expose a partial surface of the explosive material.

The first linear shaped charge support structure 410 and the second linear shaped charge support structure 420 may each abut the first non-linear shaped charge support structure 470, as shown in FIG. 4. The third linear shaped charge support structure 440 and the fourth linear shaped charge support structure 450 may also each abut the second non-linear shaped charge support structure 480, also shown in FIG. 4. When abutting a non-linear shaped charge support structure, a linear shaped charge support structure may be in contact face-to-face with the non-linear shaped charge support structure. Alternatively, the non-linear shaped charge support structure may receive at least part of the linear shaped charge support structure. This may be achieved by way of the aperture previously described. The aperture may be non-specifically shaped to receive at least part of the linear shaped charge support structure or linear shaped charge, or both. The aperture may also instead be specifically shaped to receive at least part of the linear shaped charge support structure or linear shaped charge, or both. This specific shape may correspond to the canted configuration of the linear shaped charge support structure or linear shaped charge, or both. For example, the aperture may substantially match a canted cross section of an end face of the linear shaped charge support structure or linear shaped charge, or both.

In some embodiments, at least one of: the third linear shaped charge support structure 440 comprises a third linear liner for forming the third linear shaped charge 442; the fourth linear shaped charge support structure 450 comprises a fourth linear liner for forming the fourth linear shaped charge 452; the first non-linear shaped charge support structure 470 comprises a first liner for forming the first non-linear shaped charge 475; or the second non-linear shaped charge support structure 480 comprises a second liner for forming the second non-linear shaped charge 485. Either of such linear liners may be in accordance with embodiments of a linear liner described previously.

The shaped charge support frame 400 may be made from material such as fibre glass, plastic polymer (e.g. polyvinyl chloride), thermoplastic polymer (e.g. Acrylonitrile-Butadiene-Styrene), aluminum, or other such suitable structural material.

In embodiments, a corner may be cut in a material using two linear shaped charges 105, 205 supported by linear shaped charge support structures 100, 200 in a canted configuration, as described with respect to the figures. A jet formed by a linear shaped charge propagates towards the target object along the length of the linear shape charge. The jet is planar and orthogonal to the longitudinal surface applied to the target. Thus, if a linear shaped charge is canted, the plane of the jet produced is canted in the same way: the plane tilts, twists, banks for example in accordance with the tilting, twisting, banking for example of the linear shaped charge. When trying to cut a corner, jet planes of two linear shaped charges placed orthogonally to one another in plan view, without canting either of them, will not intersect within the target material and so a cut cannot be completed across a corner. As described above, even when using flexible linear shaped charges, the characteristic minimum bend radius places a practical limitation on corner cutting. Embodiments described herein utilise the effect of canting linear shaped charges such that the jet planes produced do intersect one another within the target material, and so complete a cut across a corner. The relative amount of canting can change the point or line of intersection between the jet planes, and thus the depth of penetration within the material.

The shaped charge support frame 400 may have a polygon arrangement or formation which allows more than one corner to be cut using more than two linear shaped charges. Thus, different polygon shapes can be cut out of a target object by arranging the linear shaped charges, supported by linear shaped charge support structures, according to a frame with a corresponding polygon formation. For example, in the parallelogram arrangement shown in FIG. 4, four linear shaped charges 412, 422, 442, 452, supported by linear shaped charge support structures 410, 420, 440, 450 can be detonated to cut the four corners of the parallelogram, where they meet in pairs. In embodiments, timing of detonating two diagonally opposite non-linear shaped charges, and/or variables of the linear shaped charges, for example their lengths, thicknesses, and/or explosive loadings are selected such that, after detonation, the two energy wave-fronts resulting from detonation arrive at each corner substantially simultaneously. This improves the effectiveness of cutting a corner with this apparatus.

In application, the parallelogram arrangement of four linear shaped charges supported by linear shaped charge support structures shown in FIG. 4 could be used to cut, for example, a target object such as a sheet of metal or metal grid. The cuts at the four corners would be completed due to the effect of the linear shaped charges being in canted configurations, and a corresponding parallelogram based cut-out would be formed. The target object, for example as part of a hull of a ship or fuselage of an aircraft, could then be breached if the cut-out in the metal were large enough for a human body to pass through for example.

When faced with a material such as reinforced concrete, however, which comprises reinforcement such as an embedded steel grid within concrete, a parallelogram frame of linear shaped charge support structures supporting linear shaped charges may still struggle to cut through the material and therefore breach the target object as desired.

For these applications the parallelogram arrangement of four linear shaped charges supported by linear shaped charge support structures shown in FIG. 4 may also comprise at least one non-linear shaped charge 475, supported by a non-linear shaped charge support structure 300, 470, arranged at a corner of the parallelogram arrangement. When a linear shaped charge is placed abutting, and/or in intimate contact with, the non-linear shaped charge supported by the non-linear shaped charge support structure 300, 470, detonation of the non-linear shaped charge will subsequently detonate the linear shaped charge. For example, the non-linear shaped charge support structure 300, 470 comprises an aperture 320 as previously described, such that explosive material comprised as part of the non-linear shaped charge is exposed through the aperture and can contact an end face of explosive material of the abutting linear shaped charge. This contact may be considered 'intimate contact' or an 'interference fit', for example without an air gap, such that detonation of the non-linear shaped charge subsequently detonates the linear shaped charge. Thus, if a non-linear shaped charge support structure 470 is arranged at a corner of the parallelogram arrangement abutting two linear shaped charges 412, 422 or their support structures 410, 420 as shown in FIG. 4, detonation of the non-linear shaped charge 475 can subsequently detonate the two linear shaped charges substantially simultaneously. Substantially simultaneously is for example a time difference of substantially less than 1 second within acceptable measuring tolerances, for example less than 500 milliseconds. In other embodiments, a separate explosive material from the non-linear shaped charge may be in contact with that of the linear shaped charge and detonation may be triggered by detonation of the non-linear shaped charge.

In embodiments for cutting parallelogram-shaped holes from target objects made from material such as reinforced concrete, a second non-linear shaped charge 485 supported by a second non-linear shaped charge support structure 300, 480 is arranged at a second corner of the parallelogram arrangement of the shaped charge support frame 400. The second corner is diagonally opposite the first corner. This second non-linear shaped charge support structure 300, 480 abuts two further linear shaped charges 442, 452 or their support structures 440, 450 as described above with respect to the arrangement at the first corner, and as shown in FIG. 4. Upon substantially simultaneous detonation of the two non-linear shaped charges 475, 485, metal slugs are formed by the non-linear liners and propagate towards the target object, normal to a target surface of the target object. If the target object is made from reinforced concrete, the concrete is cracked, shattered, and/or spalled, exposing the underlying reinforcement structure, for example a steel grid. The abutting linear shaped charges are also subsequently detonated substantially simultaneously by virtue of for example intimate contact with respective non-linear shaped charges. The canted configuration of the linear shaped charges 412, 422, 442, 452, supported by their respective support structures 410, 420, 440, 450, means that the four jet planes produced are correspondingly canted, as described above. Thus, in accordance with the description above of how two canted linear shaped charges can cut a corner, the four linear shaped charges can cut four corners of the underlying reinforcement structure, as well as the edges along their respective longitudinal axes. The jets from the linear shaped charge cut the reinforcement structure within the now cracked, shattered and/or spalled concrete. This parallelogram arrangement of non-linear and linear shaped charges in a canted configuration can therefore cut a corresponding parallelogram shape out of a target object made out of a material such as reinforced concrete.

In embodiments, the shaped charge support frame 400 comprises two or more frame pieces. For example, with reference to FIG. 4, the shaped charge support frame 400 may comprise a first frame piece and a second frame piece. The first frame piece may comprise the first linear shaped charge support structure 410 and the second linear shaped charge support structure 420 each abutting the first non-linear shaped charge support structure 470. Thus, this first frame piece may be L-shaped, as shown in FIG. 4. The second frame piece may comprise the third linear shaped charge support structure 440 and the fourth linear shaped charge support structure 450 each abutting the second non-linear shaped charge support structure 480. The second frame piece may also be L-shaped, as shown in FIG. 4. The first frame piece and the second frame piece may comprise corresponding attachment parts, for example bosses or pins and holes, such that the first and second frame pieces may be attached to each other. Thus, the first frame piece may be positioned on the target object and secured or held in place, for example by an adhesive, before the second frame piece is attached to the first frame piece to form the complete shaped charge support frame 400 positioned on the target object. The corresponding attachment parts of the first and second frame pieces may allow the second frame piece to hang from, or be otherwise supported by, the first frame piece that is secured to the target object. The shaped charge support frame 400 comprising two or more frame pieces that are attachable and detachable to each other allows for easier storage and transportation of the entire shaped charge support frame 400.

In further embodiments, the point of initiation of the non-linear shaped charge(s) is chosen such that a resulting energy wave-front propagating towards the target object reaches the target surface of the target object at a substantially simultaneous time as when an energy wave-front propagating away from the target object reaches the linear shaped charge abutting the non-linear shaped charge. For example, the point of detonation may be configured to be at ⅓ of the height of the non-linear shaped charge away from the target object. The linear shaped charge may then be configured to be at ⅔ of the height of the non-linear shaped charge away from the target object. Upon detonation of the non-linear shaped charge in such embodiments, the energy wave fronts propagate away from the detonation point and reach the target surface and the abutting linear shaped charges at substantially the same time. This means that when the linear shaped charges are detonated, the target object has already been contacted by the energy released from detonating the non-linear shaped charges. This has the effect of exposing any underlying reinforcement structure of the target object (for example if the target object is made from reinforced concrete) to the linear shaped charges before the linear jets reach the underlying reinforcement structure after their firing. This increases the cutting efficiency of the linear jets, as they can cut through the reinforcement structure without having to cut through a substantial part of the surrounding structure of the target object first, such as the concrete of reinforced concrete.

The efficiency of the linear cutting can also be adjusted by adjusting the relative height of the linear shaped charge support structures with respect to the non-linear shaped charge support structures that they may abut. In other words a spacing of the linear shaped charge from the target may be adjusted/selected. This height of the linear shaped charge support structures away from the target surface directly affects the resulting stand-off distance of the linear shaped charges they respectively support in a canted configuration. Thus, if the depth of the target object is known, this height can be tuned such that when the surrounding structure (for example concrete) of the target object is removed to expose the underlying reinforcement structure, the stand-off distance of the linear shaped charges is optimised with respect to the reinforcement structure, which is the cutting target of the linear shaped charges.

In embodiments, the stand-off distance, for example the distance 140, 145 in FIG. 1 between a point of the liner nearest the target surface 150 and the target surface is constant. For example, the distance 140 in FIG. 1*b* and distance 145 in FIG. 1*a* are equal or substantially equal within acceptable performance tolerances along the length of the linear shaped charge. In these embodiments, the planes of the cutting jets intersect before or at the target surface.

Figure 5A:
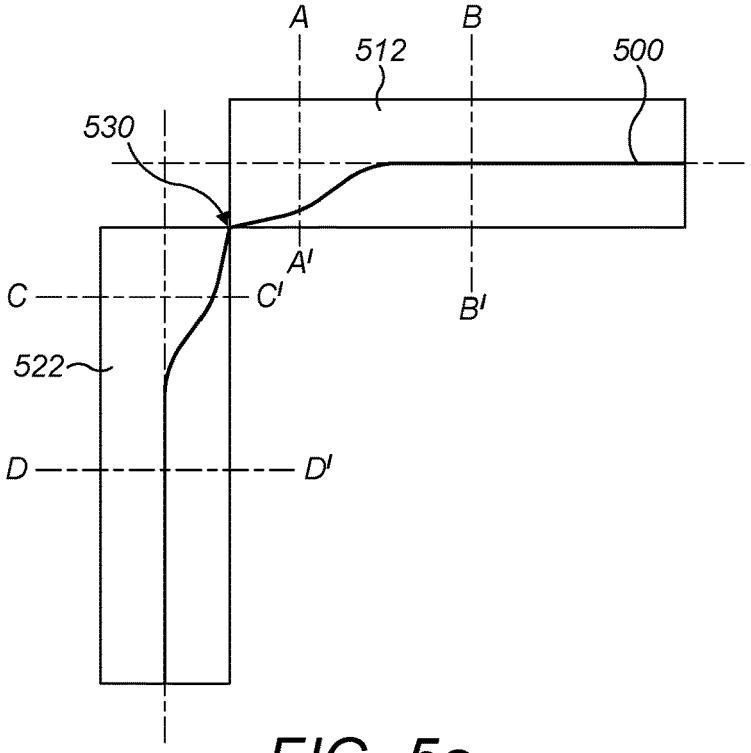
FIGS. 5*a* and 5*b* show schematically cutting of a corner of a target material, according to embodiments.

FIG. 5*a* shows an arrangement, in plan view, of a first linear shaped charge 512, which for example corresponds to 412 in FIG. 4, and a second linear shaped charge 522, which for example corresponds to 422, arranged at a corner. These linear shaped charges may be supported by corresponding linear shaped charge support structures such as those previously described, for example 410, 420 in FIG. 4. A first cross section AA' of the first linear shaped charge 512 is canted relative to a second cross section BB' of the first linear shaped charge 512. The second linear shaped charge is configured in the corresponding way, with cross section CC' canted relative to cross section DD'. Line 500 shows the resulting cut in a surface of a target object positioned beneath the arrangement of linear shaped charges in the embodiment above, with for example the stand-off distance to the surface of the target object constant (and for example optimised for the geometry of the linear shaped charges). As can be seen, the line forms a shape known as a "Cupid's bow" extending from the corner 530. The curves of the bow are caused by the canting of the linear shaped charges. The jets from each linear shaped charge 512, 522 penetrate into the target on their respective canted trajectories.

Figure 5B:
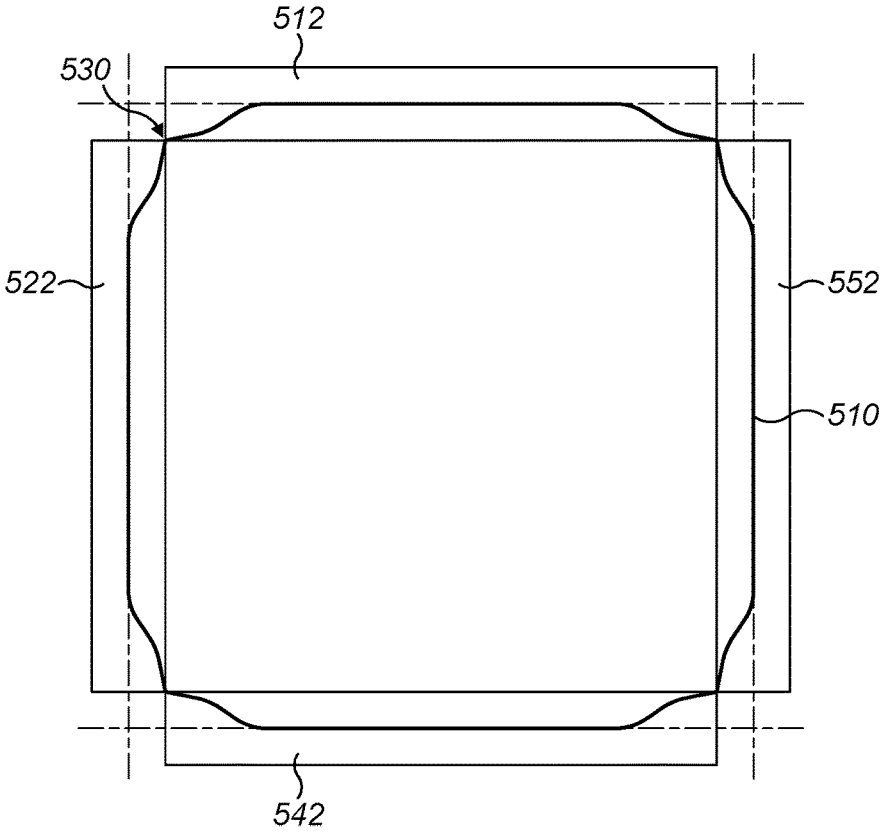

FIG. 5*b* shows an example of a parallelogram arrangement of four linear shaped charges 512, 522, 542, 552 which for example correspond to the four linear shaped charges 412, 422, 442, 452 in FIG. 4. These linear shaped charges may be supported by corresponding linear shaped charge support structures such as those previously described, for example 410, 420, 440, 450 as described with regard to FIG. 4. The parallelogram arrangement may be an arrangement of four corner arrangements shown in FIG. 5*a* and previously described. In the particular embodiment shown in FIG. 5*b*, the arrangement is square. Each of the four linear shaped charges has a cross section that is canted relative to another cross section, as described previously with respect to FIGS. 1*a* to 1*c*. Line 510 shows the resulting cut in a target object positioned beneath the arrangement of linear shaped charges in the embodiments above, with the stand-off distance to the surface of the target object constant (and for example optimised for the geometry of the linear shaped charges). As can be seen, the line forms a shape known as a "Cupid's bow" extending from the corners, including corner 530. The curves of the bow are caused by the canting of the linear shaped charges. The jets from each linear shaped charge 512, 522, 542, 552 penetrate into the target on their respective canted trajectories. The resulting cut-out shape may be considered a square or parallelogram with bulged sides.

Figure 6A:
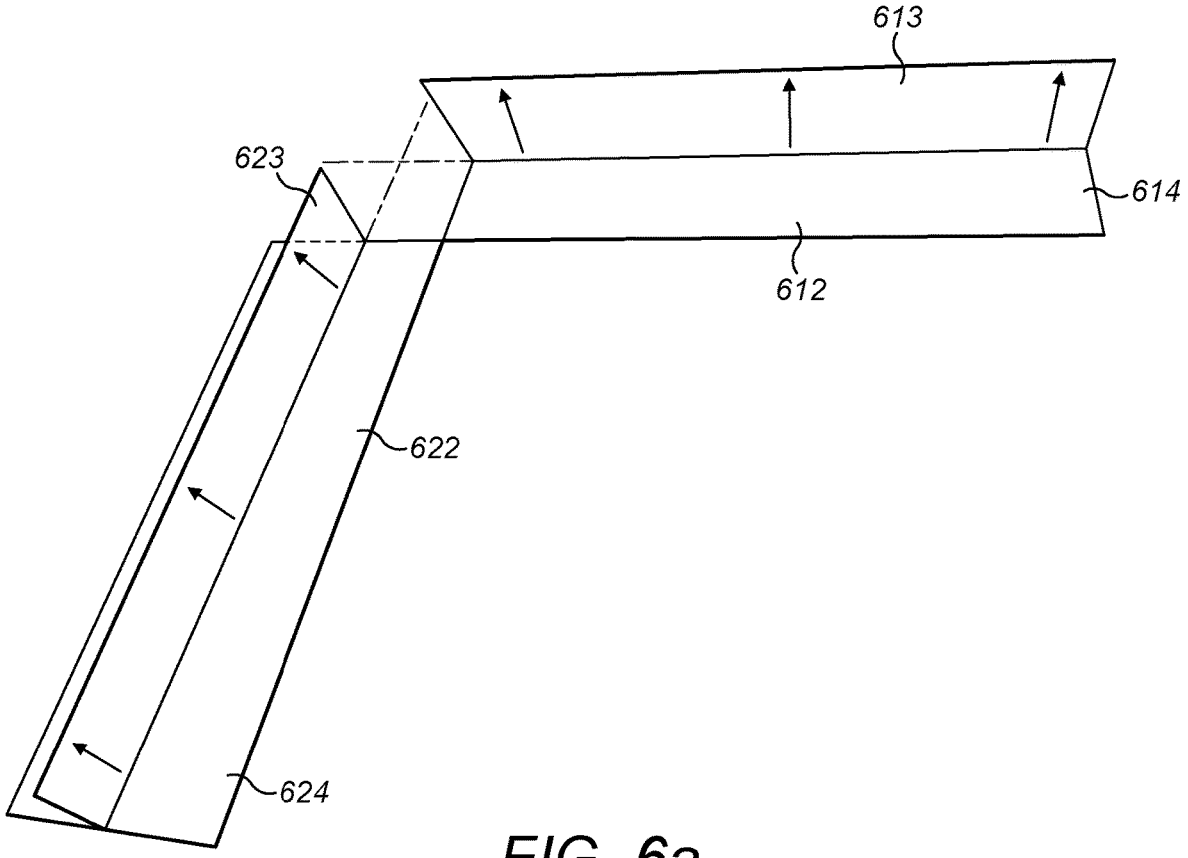
FIGS. 6*a*, 6*b* and 6*c* show schematically how jets of detonated linear shaped charges are used to cut a corner in a target material, according to embodiments.
Figure 6B:
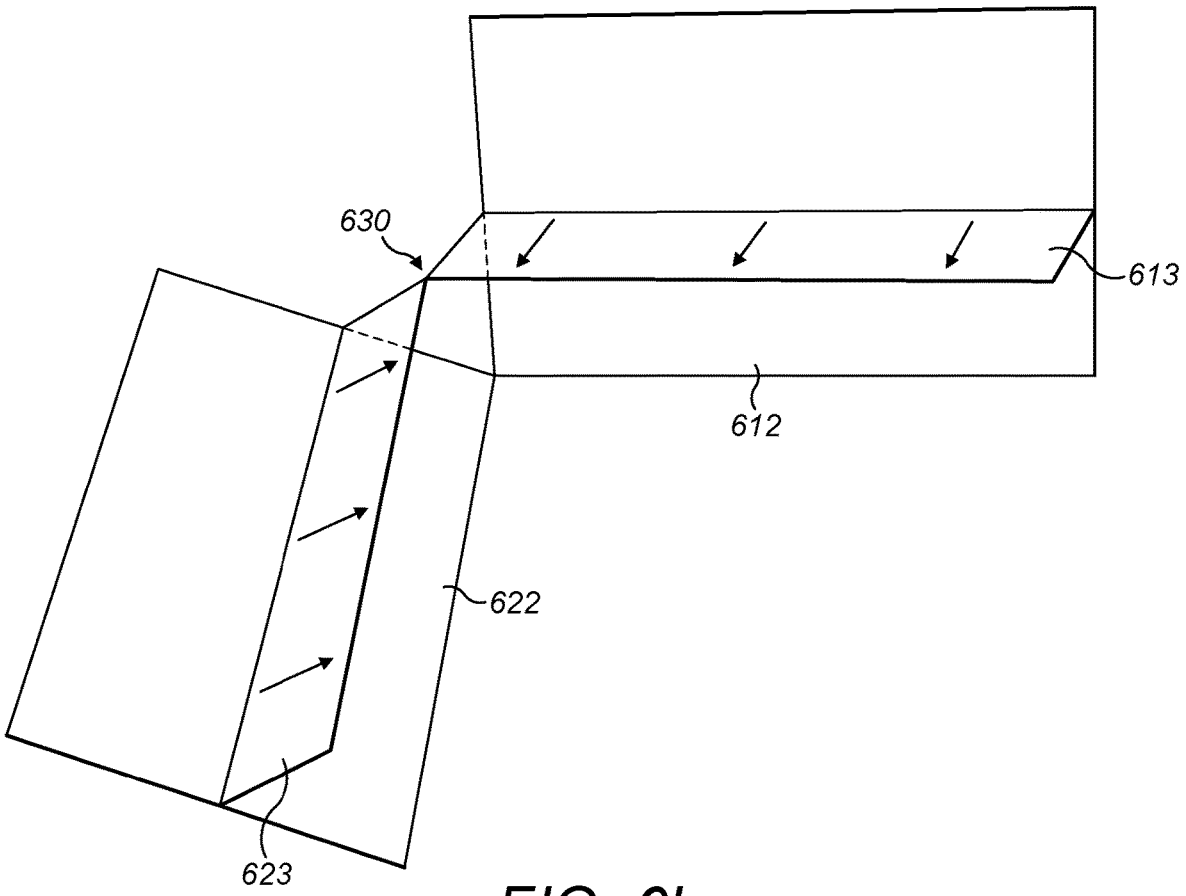
Figure 6C:
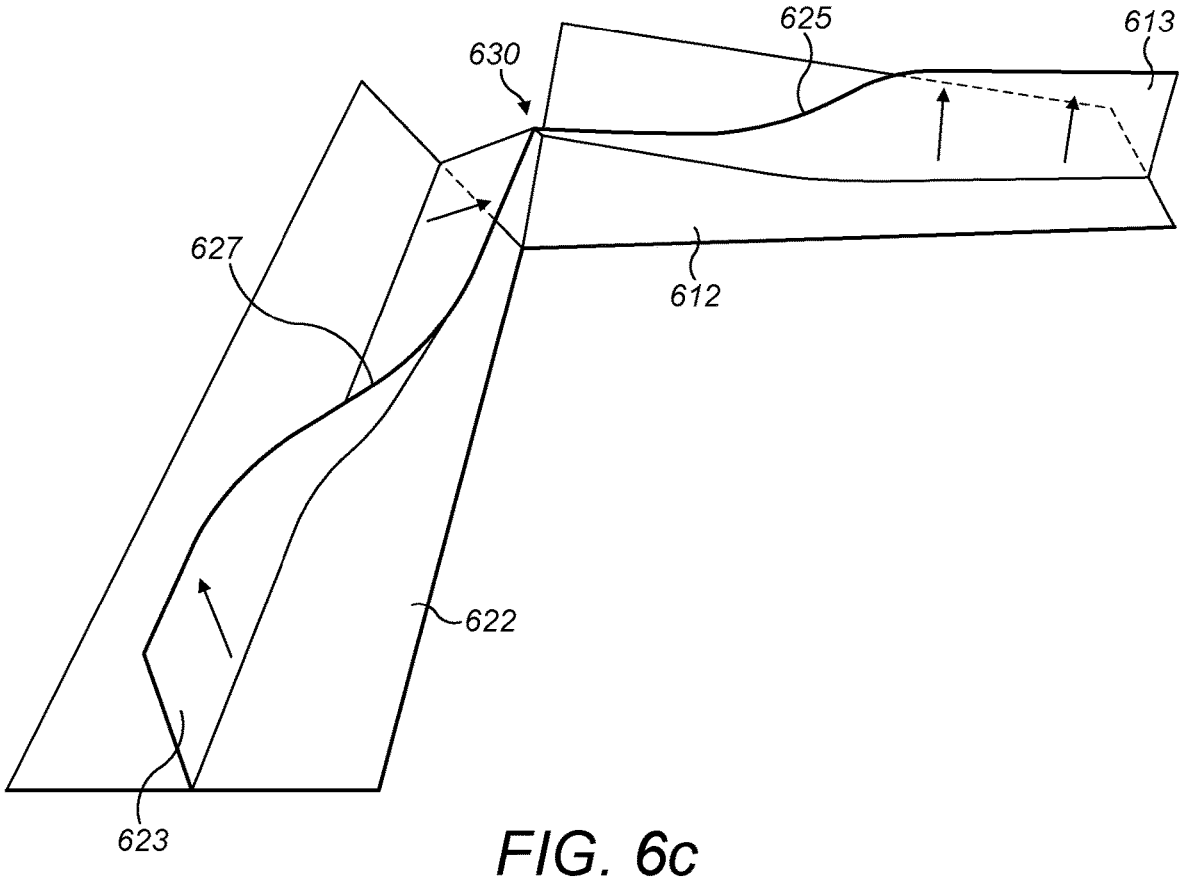

FIGS. 6*a* to 6*c* illustrate the effect of canting linear shaped charges on the jets that are produced. FIG. 6*a* shows schematically a perspective of an arrangement of two linear shaped charges 612 and 622, which for example corresponds to the linear shaped charges 412, 512 and 422, 522 of FIGS. 4, 5 respectively in previously described embodiments. In some embodiments, these linear shaped charges are supported by corresponding linear shaped charge support structures, as previously described. FIG. 6*a* shows a perspective of the arrangement in FIG. 5*a*, but inverted to show the jets more clearly. The jet 613 produced by the linear shaped charge 612 travels away from the face 614 for application of the linear shaped charge 612 to a surface of a target or linear shaped charge support structure. Similarly, the jet 623 produced by the linear shaped charge 622 travels away from the face 624 for application of the linear shaped charge 622 to a surface of a target or linear shaped charge support structure. In FIG. 6*a*, the linear shaped charges 612, 622 are not canted. Thus, the produced jets 613, 623 travel orthogonally to each other and do not intersect at any point.

FIG. 6*b* shows the two linear shaped charges 612, 622 both canted but with no relative canting between cross sections, as previously described. Thus, each linear shaped charge may be considered to be tilted, with a longitudinal surface of the linear shaped charge which would be applied to a target surface instead canted or tilted relative to, and therefore non-parallel with, a target surface. Thus, the jets 613, 623 in this embodiment do intersect for example at corner 630, but as there is no part of either jet travelling purely perpendicularly towards the target surface, the average penetration is lower than when a jet of the same energy penetrates the target surface perpendicularly, as previously described.

FIG. 6*c* shows the two linear shaped charges 612, 622 both canted but with relative canting between cross sections of the same linear shaped charge, as previously described with regard to FIGS. 1*a* to 1*c*. The effect on the produced jets can be seen, with the Cupid's bow shape extending from the point or corner 630 where the jets 613, 623 intersect. The corner 630 may correspond to the corner 530 in FIGS. 5*a* and 5*b*. The lines 625 and 627 are the respective leading edges of the jets 613, 623, and each correspond with the respective cut line of the target surface; for example line 625 corresponds with the line 500 in FIG. 5*b*.

Figure 7:
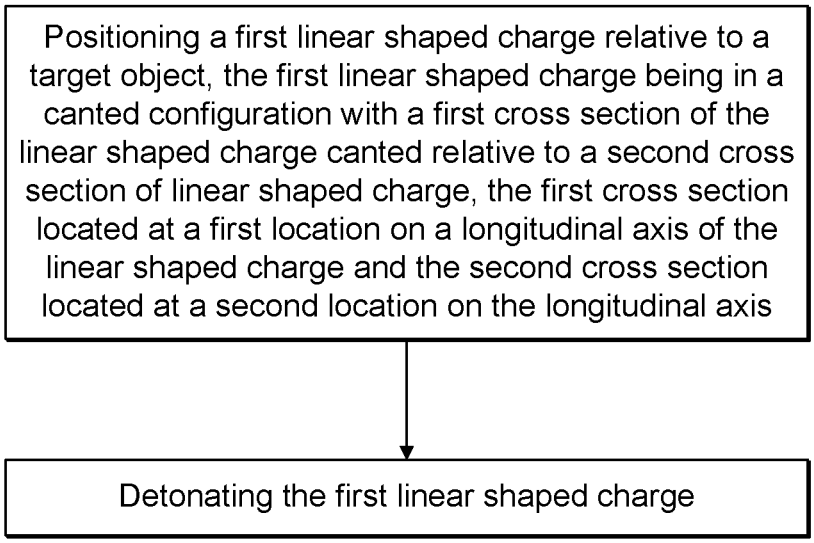
FIG. 7 shows a method according to embodiments.

A method for cutting a structure according to embodiments is now described, with reference to FIG. 7, the method comprising positioning a first linear shaped charge relative to a target object, the first linear shaped charge being in a canted configuration. A first cross section of the linear shaped charge is canted relative to a second cross section of the linear shaped charge, for example as described above. The first cross section is located at a first location on a longitudinal axis of the linear shaped charge. The second cross section is located at a second location on the longitudinal axis.

The method then comprises positioning a second linear shaped charge relative to the target object.

The method also comprises detonating the first linear shaped charge comprising a first longitudinal axis, and detonating the second linear shaped charge comprising a second longitudinal axis.

In some embodiments of the method, a third cross section is canted relative to a fourth cross section of the second linear shaped charge. The third cross section is located at a third location on the second longitudinal axis, and the second cross section is located at a fourth location on the second longitudinal axis, for example as described above.

In some embodiments, the method comprises positioning the first linear shaped charge and the second linear shaped charge such that the first longitudinal axis and the second longitudinal axis lie in a common plane and an angle between the first longitudinal axis and the second longitudinal axis is substantially between 45 degrees and 135 degrees in the common plane, for example, as described previously for embodiments, and includes the various sub-ranges stated within the 45 to 135 degrees range.

In some embodiments, the method comprises arranging an end face of the first linear shaped charge adjacent to, for example abutting or close to, an end face of the second linear shaped charge. In further embodiments, as explained for earlier embodiments, the method comprises detonating the first linear shaped charge and detonating the second linear shaped charge, such that a first wavefront formed by detonating the first linear shaped charge arrives at the end face of the first linear shaped charge substantially simultaneously with a second wavefront formed by detonating the second linear shaped charge arriving at the end face of the second linear shaped charge. Substantially simultaneously is for example a time difference of substantially less than 1 second, for example within acceptable measuring tolerances, for example less than 500 milliseconds. Timing of detonating two linear shaped charges can improve the efficiency of the two linear cutting jets working together to cut a corner in a target object, for example if the detonation wavefront reaches the end face of each of two linear shaped charges substantially simultaneously, which end faces are each located at a corner of a shape to be cut from a target object. Identical linear shaped charges of identical length may be detonated substantially simultaneously and at the same distance from the respective end faces of the linear shaped charges. Alternatively, different linear charges of different lengths may be used. These may be detonated at the same distance from their respective end faces and/or at different times.

In some embodiments, the method comprises detonating a third linear shaped charge comprising a third longitudinal axis, and detonating a fourth linear shaped charge comprising a fourth longitudinal axis.

In further embodiments, a fifth cross section is canted relative to a sixth cross section of the third linear shaped charge, and/or a seventh cross section is canted relative to an eighth cross section of the fourth linear shaped charge. The fifth cross section is located at a fifth location on a third longitudinal axis of the third linear shaped charge. The sixth cross section is located at a sixth location on the third longitudinal axis. The seventh cross section is located at a seventh location on a fourth longitudinal axis of the fourth linear shaped charge. The eighth cross section located at an eighth location on the fourth longitudinal axis. Further details are explained above for example.

In some embodiments, the method comprises positioning the third linear shaped charge and the fourth linear shaped charge such that the third longitudinal axis and the fourth longitudinal axis lie in a common plane and an angle between the third longitudinal axis and the fourth longitudinal axis is substantially between 45 degrees and 135 degrees in the common plane. Further details are given for example in embodiments above, and it is to be appreciated that sub-ranges within the 45 to 135 degree range described earlier apply here too.

In some embodiments, the method comprises arranging an end face of the third linear shaped charge adjacent to an end face of the fourth linear shaped charge. In further embodiments, the method comprises detonating the third linear shaped charge and detonating the fourth linear shaped charge, such that a third wavefront formed by detonating the third linear shaped charge arrives at the end face of the third linear shaped charge substantially simultaneously with a fourth wavefront formed by detonating the fourth linear shaped charge arriving at the end face of the fourth linear shaped charge. The description above regarding detonating the first linear shaped charge and detonating the second linear shaped charge also applies here to detonating the third linear shaped charge and detonating the fourth linear shaped charge in these further embodiments. Hence, with appropriate timing of detonating for example four linear shaped charges, four corners of a shape to be cut from a target object may be effectively cut.

In some embodiments, the method comprises arranging the first linear shaped charge, the second linear shaped charge, the third linear shaped charge, and the fourth linear shaped charge respectively at a first side, a second side, a third side and a fourth side of a parallelogram. In further embodiments, the method comprises arranging a first non-linear shaped charge at a first corner of the parallelogram, and arranging a second non-linear shaped charge at a second corner of the parallelogram, with the second corner diagonally opposite the first corner. This arranging is such that the first linear shaped charge and the second linear shaped charge abut the first non-linear shaped charge, and the third linear shaped charge and the fourth linear shaped charge abut the second non-linear shaped charge. In further embodiments, at least one of: the first linear shaped charge; or the second linear shaped charge; comprises at least one aperture and explosive material with an explosive material surface exposed through the at least one aperture. This may help to ensure that a linear shaped charge and non-linear shaped charge are intimately contacting, or have an interference fit, when positioned so as to abut each other, as in some embodiments described above.

In some further embodiments, the method comprises detonating the first non-linear shaped charge to detonate the first linear shaped charge and the second linear shaped charge; and detonating the second non-linear shaped charge to detonate the third linear shaped charge and the fourth linear shaped charge. For example, when a linear shaped charge and non-linear shaped charge are placed in intimate contact with each other, detonation of one of the charges may cause detonation of the other charge. Timings of wave-front propagation can therefore be utilised by changing the point of detonation of the non-linear shaped charge in order to affect when the linear shaped charge detonates. The description above regarding this, and its application to target objects of reinforced materials such as concrete with an embedded steel grid, applies here to the method for cutting a structure also.

In some further embodiments, the first non-linear shaped charge and/or the second non-linear shaped charge comprises a conical liner or a concave liner. The concave liner may have a dish shape for forming EFPs when comprised as part of an EFP charge. Other features in respect of the support structures and charges described above may apply in embodiments described here also.

Further embodiments and features of embodiments described above are envisaged.

For example, different types of linear shaped charges and non-linear shaped charges are referred to above. A linear shaped charge, for example that of FIG. 1*b*, may comprise an explosive element (e.g. 106), a liner (e.g. 107), and in some examples a face (e.g. 108) for application to a target object, with the liner arranged for projection towards the face when the explosive element is detonated. For example, as will be readily appreciated by the skilled person, a liner as described earlier may be before detonation a longitudinal element having a V-shaped cross section and formed for example of copper or a material comprising copper or another suitable metal. The apex of the V-shape is located further from the target object than the two sides of the V-shape.

In some embodiments, the liner may be a metallic layer which extends away from a side of the charge to be applied to a target object, to surround, when viewed in cross-section, the explosive material of the linear shaped charge. Such a liner may have a V-shaped cross section.

In some embodiments, a canting of the liner may provide the canted configuration to the linear shaped charge, for example with a rigidity of the liner holding the canted configuration for the linear shaped charge. Thus it is anticipated that by saying that a cross section of a linear shaped charge is canted relative to a different cross section of that charge, this includes a cross section of the liner being canted relative to a different cross section of the liner, with not all other features of the linear shaped charge necessarily also canted relative to each other at different cross sections.

Linear shaped charges may comprise a space between the liner and the face, the liner being arranged for projection through the space after the explosive element (located on a side of the liner furthest from the target object) is detonated. At least part of the space may be filled with a filling material. Linear shaped charges may also comprise a casing surrounding at least part of the explosive element. The casing and/or filling material may comprise foam, for example low density polyethylene foam (LDPE). The casing and the filling material may be integrally formed. A linear shaped charge may be flexible along a longitudinal axis. This allows the target object to be cut with a curved shape when the linear shaped charge is detonated. In examples, flexible typically means that the linear shaped charge may be bent, twisted, or otherwise deformed, for example along or relative to a longitudinal axis of the linear shaped charge, for example by a human with their hands without any tools. A linear shaped charge may have elastic properties, so that the linear shaped charge at least partly returns to a pre-deformed configuration. In other embodiments, the linear shaped charge may have plastic properties, so that for example the linear shaped charge at least partly retains a deformed configuration after being deformed. In some embodiments, a linear shaped charge may be similar to a linear shaped charge described above, but which is substantially non-flexible, and therefore not for example deformable by a human with their hands without any tools. Such examples may include a linear shaped charge with a rigid copper or other metal liner, which liner may have a pre-formed canted configuration, in accordance with for example a canted configuration described previously. Such non-flexible, rigid, or pre-canted linear shaped charges may be provided separately and used without a linear shaped charge support structure such as tracks described above. Thus, with the pre-canted linear shaped charge, for example a rigid linear shaped charge with a canted configuration, a shape with corners may be cut in a target object without needing an additional linear shaped charge support structure to the canted rigid linear shaped charge itself. Or, in other examples, a linear shaped charge may be formed in situ by applying explosive material onto a pre-canted copper liner which is part of a linear shaped charge support structure, as described previously. In this way, the liner of the linear shaped charge to be formed acts as a linear shaped charge support structure. It is envisaged that other shapes may be cut from a target structure using at least one linear shaped charge and for example a non-linear shaped charge in accordance with those described above. A linear shaped charge support structure and/or non-linear shaped charge support structure may also be used in further embodiments to cut different shapes than a parallelogram. Such shapes may have corners which benefit from canting of at least one linear shaped charge.

It is to be appreciated that in some embodiments, a kit may be provided for assembling a frame in situ for cutting a desired shape in a target structure. The kit may comprise at least one support structure described above, for example one or more linear shaped charge support structure and/or one or more non-linear shaped charge support structure, which facilitate and/or utilise canting of a linear shaped charge. In some kits, and indeed in embodiments described above, at least one of the support structures may be configured for attachment to another support structure. For example one or both of a linear shaped charge support structure and a non-linear shaped charge support structure may be configured to interfit or attach to each other. Further, attachment parts, for example straps, adhesive, clips, fasteners or other mechanisms may be provided to attach a linear shaped charge and/or a non-linear shaped charge to a respective linear or non-linear shaped charge support structure. Additionally, or alternatively, an acrylic adhesive may be provided to attach a linear shaped charge and/or a non-linear shaped charge to a respective linear or non-linear shaped charge support structure.

A frame is described above in relation to various embodiments. It is to be appreciated that a frame is typically any structure, whether a separate structure, or made of several sub-structures, which provides support. For example, a frame in some embodiments is formed of one or more linear shaped charge support structures and at least one non-linear shaped charge support structure as described above. There may be no further separate structure than the individual support structures for the shaped charges. In other embodiments, the frame may comprise a board, sheet, moulded structure, panel, housing, guide or other structure which is configured to receive any of the support structures described previously. For example the frame may hold a linear shaped charge support structure in position relative to a non-linear shaped charge support structure. The frame may be further configured for attachment to a target object, for example with adhesive or for example with a moulding or attachment point for a prop or other support for holding the frame against a target object, for example where the target object surface is vertical as in the case of a wall.

A support structure is described in various embodiments above. A support structure is for example a structure which provides support to a further structure or element, such as a linear or non-linear shaped charged. To provide support typically involves providing some mechanical support, by holding and/or guiding the further structure or element for example in a desired position.

Embodiments are described with two linear shaped charges positioned relative to each other by an angle of substantially between 45 and 135 degrees. Further, embodiments are described with at least one end of a linear shaped charge canted. It is to be appreciated that canting of at least one end of a linear shaped charge may be used where two linear shaped charges are positioned in relation to each other with an angle outside of the range of 45 to 135 degrees. Further, two ends of one linear shaped charge may be arranged adjacent to each other, for example side by side, with canting of those ends used to join a cut by a jet along the length of the linear shaped charge.

In further embodiments, a frame is envisaged comprising a linear shaped charge support structure and a non-linear shaped charge support structure, which support structures may be in accordance with any such structures described above. The support structures may be located relative to each other for cutting a target object upon detonation of the charges being supported. In this way, as will be clear from the example described above in respect of reinforced concrete, the properties of one type of charge (e.g. a non-linear shaped charge) can be combined with the properties of a different type of charge (e.g. a linear shaped charge) to improve cutting of certain types of materials or targets. For example, in the case of reinforced concrete, the non-linear shaped charge is used to break the concrete, followed by the linear shaped charge being used to cut the embedded steel. In this way, it is envisaged in embodiments that a frame or other structure is configured to support a combination of at least one linear shaped charge and at least one non-linear shaped charge to cut a target object more effectively than using one type of shaped charge alone.

Further examples are envisaged within the scope of the sets of numbered clauses below.

It is to be understood that any feature described in relation to any one embodiment may be used alone, or in combination with other features described and may also be used in combination with one or more features of any other of the embodiments, or any combination of any other of the embodiments. Furthermore, equivalents and modifications not described above may also be employed without departing from the scope of the accompanying claims.

Clause Set I

A reference made by a clause within this set to one or more other clauses is to be interpreted as a reference to those clauses within this set of clauses only.

1. A linear shaped charge support structure configured to support a linear shaped charge in a canted configuration with a first cross section of the linear shaped charge canted relative to a second cross section of the linear shaped charge, the first cross section located at a first location on a longitudinal axis of the linear shaped charge and the second cross section located at a second location on the longitudinal axis.

2. A linear shaped charge support structure according to clause 1, wherein the support structure comprises a track for supporting the linear shaped charge along a longitudinal surface of the linear shaped charge.

3. A linear shaped charge support structure according to clause 1, comprising at least two substantially parallel rails for contacting the linear shaped charge.

4. A linear shaped charge support structure according to clause 2, wherein the track comprises a longitudinal track surface for contacting the longitudinal surface of the linear shaped charge, wherein optionally the longitudinal track surface comprises a slot extending along at least part of a longitudinal axis of the track.

5. A linear shaped charge support structure according to clause 1, comprising a liner for a linear shaped charge.

6. A non-linear shaped charge support structure configured to support a non-linear shaped charge.

7. A non-linear shaped charge support structure according to clause 6, wherein the non-linear shaped charge is selected from a group consisting of a conical charge, an explosively formed penetrator (EFP) charge, and a contact charge.

8. A non-linear shaped charge support structure according to clause 6, configured to support a non-linear shaped charge comprising a conical liner or a concave liner.

9. A non-linear shaped charge support structure according to clause 6, comprising a liner for a non-linear shaped charge.

10. A non-linear shaped charge support structure according to clause 9, the liner having a conical shape or a concave shape.

11. A non-linear shaped charge support structure according to any of clauses 6 to 10, comprising an aperture and explosive material, with an explosive material surface of the explosive material exposed through the aperture.

12. A shaped charge support frame comprising:

a first linear shaped charge support structure according to any one of clauses 1 to 5 and having a first longitudinal axis, the linear shaped charge being a first linear shaped charge; and a second linear shaped charge support structure having a second longitudinal axis and configured to support a second linear shaped charge.

13. A shaped charge support frame according to clause 12, wherein the second linear shaped charge support structure is a linear shaped charge support structure according to any one of clauses 1 to 5.

14. A shaped charge support frame according to clause 12 or 13, wherein the first longitudinal axis and the second longitudinal axis lie in a common plane and an angle between the first longitudinal axis and the second longitudinal axis is substantially between 45 degrees and 135 degrees, between 60 to 120 degrees, between 75 to 105 degrees, between 80 to 100 degrees, between 85 to 95 degrees, between 87.5 to 92.5 degrees, substantially 90 degrees, or 90 degrees in the common plane.

15. A shaped charge support frame according to any one of clauses 12 to 14 comprising:

a third linear shaped charge support structure having a third longitudinal axis and configured to support a third linear shaped charge; and a fourth linear shaped charge support structure having a fourth longitudinal axis and configured to support a fourth linear shaped charge.

16. A shaped charge support frame according to clause 15, wherein:

the third linear shaped charge support structure is a support structure according to any one of clauses 1 to 5 and the fourth linear shaped charge support structure is a support structure according to any one of clauses 1 to 5.

17. A shaped charge support frame according to clause 15 or 16, wherein the first linear shaped charge support structure, the second linear shaped charge support structure, the third linear shaped charge support structure and the fourth linear shaped charge support structure are arranged respectively at a first side, a second side, a third side and a fourth side of a parallelogram.

18. A shaped charge support frame according to clause 17, comprising a first non-linear shaped charge support structure according to any one of clauses 6 to 11, configured to support a first non-linear shaped charge, and arranged at a first corner of the parallelogram.

19. A shaped charge support frame according to clause 18, comprising a second non-linear shaped charge support structure according to any one of clauses 6 to 11, configured to support a second non-linear shaped charge, and arranged at a second corner of the parallelogram, the second corner diagonally opposite the first corner.

20. A shaped charge support frame according to clause 19, wherein:

the first linear shaped charge support structure and the second linear shaped charge support structure each abut the first non-linear shaped charge support structure; and the third linear shaped charge support structure and the fourth linear shaped charge support structure each abut the second non-linear shaped charge support structure.

21. A shaped charge support frame comprising:

a first linear shaped charge support structure configured to support a first linear shaped charge having a first longitudinal axis; and a second linear shaped charge support structure configured to support a second linear shaped charge having a second longitudinal axis, wherein the first longitudinal axis and the second longitudinal axis lie in a common plane and an angle between the first longitudinal axis and the second longitudinal axis is substantially between 45 degrees and 135 degrees, between 60 to 120 degrees, between 75 to 105 degrees, between 80 to 100 degrees, between 85 to 95 degrees, between 87.5 to 92.5 degrees, substantially 90 degrees within acceptable measuring tolerances, or 90 degrees in the common plane.

22. A shaped charge support frame according to clause 21, wherein the first linear shaped charge support structure is configured to support the first linear shaped charge in a canted configuration with a first cross section canted relative to a second cross section of the first linear shaped charge, the first cross section located at a first location on the first longitudinal axis and the second cross section located at a second location on the first longitudinal axis.

23. A shaped charge support frame according to clause 22, wherein the second linear shaped charge support structure is configured to support the second linear shaped charge in a canted configuration with a third cross section of the second linear shaped charge canted relative to a fourth cross section of the second linear shaped charge, the third cross section located at a third location on the second longitudinal axis and the second cross section located at a fourth location on the second longitudinal axis.

24. A shaped charge support frame according to any one of clauses 21 to 23, wherein at least one of:

the first linear shaped charge support structure comprises a first linear liner for forming the first linear shaped charge; or the second linear shaped charge support structure comprises a second linear liner for forming the second linear shaped charge.

25. A shaped charge support frame according to any one of clauses 21 to 24 comprising:

a third linear shaped charge support structure configured to support a third linear shaped charge in a canted configuration with a fifth cross section of the third linear shaped charge canted relative to a sixth cross section of the third linear shaped charge, with the fifth cross section located at a fifth location on a third longitudinal axis of the third linear shaped charge and the sixth cross section located at a sixth location on the third longitudinal axis; and a fourth linear shaped charge support structure configured to support a fourth linear shaped charge in a canted configuration with a seventh cross section of the fourth linear shaped charge canted relative to an eighth cross section of the fourth linear shaped charge, the seventh cross section located at a seventh location on a fourth longitudinal axis of the fourth linear shaped charge and the eighth cross section located at an eighth location on the fourth longitudinal axis.

26. A shaped charge support frame according to clause 25, wherein the first linear shaped charge support structure, the second linear shaped charge support structure, the third linear shaped charge support structure and the fourth linear shaped charge support structure are arranged respectively at a first side, a second side, a third side and a fourth side of a parallelogram.

27. A shaped charge support frame according to clause 26, comprising a first non-linear shaped charge support structure, configured to support a first non-linear shaped charge, and located at a first corner of the parallelogram.

28. A shaped charge support frame according to clause 27, comprising a second non-linear shaped charge support structure, configured to support a second non-linear shaped charge, and located at a second corner of the parallelogram, the second corner located diagonally opposite the first corner.

29. A shaped charge support frame according to clause 28, wherein at least one of:

the first non-linear shaped charge support structure; or the second non-linear shaped charge support structure;

comprises explosive material and an aperture configured to expose a partial surface of the explosive material.

30. A shaped charge support frame according to clause 28 or 29, wherein:

the first linear shaped charge support structure and the second linear shaped charge support structure each abut the first non-linear shaped charge support structure; and the third linear shaped charge support structure and the fourth linear shaped charge support structure each abut the second non-linear shaped charge support structure.

31. A shaped charge support frame according to any one of clauses 21 to 30, wherein at least one of:

the third linear shaped charge support structure comprises a third linear liner for forming the third linear shaped charge;

the fourth linear shaped charge support structure comprises a fourth linear liner for forming the fourth linear shaped charge;

the first non-linear shaped charge support structure comprises a first liner for forming the first non-linear shaped charge; or the second non-linear shaped charge support structure comprises a second liner for forming the second non-linear shaped charge.

32. A linear shaped charge comprising an explosive element and a liner, the linear shaped charge configured in a canted configuration with a first cross section of the linear shaped charge canted relative to a second cross section of the linear shaped charge, the first cross section located at a first location on a longitudinal axis of the linear shaped charge and the second cross section located at a second location on the longitudinal axis.

33. A linear shaped charge according to clause 32, which is a substantially non-flexible linear shaped charge.

34. A method for cutting a target object, the method comprising:

positioning a first linear shaped charge relative to a target object, the first linear shaped charge being in a canted configuration with a first cross section of the linear shaped charge canted relative to a second cross section of the linear shaped charge, the first cross section located at a first location on a longitudinal axis of the linear shaped charge and the second cross section located at a second location on the longitudinal axis; and detonating the first linear shaped charge.

35. A method according to clause 34, further comprising:

positioning a second linear shaped charge relative to the target object, the second linear shaped charge being in a canted configured with a third cross section of the second linear shaped charge canted relative to a fourth cross section of the second linear shaped charge, the third cross section located at a third location on the second longitudinal axis and the second cross section located at a fourth location on the second longitudinal axis; and detonating the second linear shaped charge.

36. A method according to clause 35, comprising positioning the first linear shaped charge and the second linear shaped charge such that the first longitudinal axis and the second longitudinal axis lie in a common plane and an angle between the first longitudinal axis and the second longitudinal axis is substantially between 45 degrees and 135 degrees, between 60 to 120 degrees, between 75 to 105 degrees, between 80 to 100 degrees, between 85 to 95 degrees, between 87.5 to 92.5 degrees, substantially 90 degrees within acceptable measuring tolerances, or 90 degrees in the common plane.

37. A method according to clause 35 or 36, comprising arranging an end face of the first linear shaped charge adjacent to an end face of the second linear shaped charge.

38. A method according to clause 37, the detonating the first linear shaped charge and the detonating the second linear shaped charge being such that a first wavefront formed by detonating the first linear shaped charge arrives at the end face of the first linear shaped charge substantially simultaneously with a second wavefront formed by detonating the second linear shaped charge arriving at the end face of the second linear shaped charge.

39. A method according to any one of clauses 34 to 38, comprising:

detonating a third linear shaped charge having a third longitudinal axis;

detonating a fourth linear shaped charge having a fourth longitudinal axis.

40. A method according to clause 39, wherein at least one of:

a fifth cross section of the third linear shaped charge is canted relative to a sixth cross section of the third linear shaped charge, the fifth cross section located at a fifth location on the third longitudinal axis of the third linear shaped charge and the sixth cross section located at a sixth location on the third longitudinal axis; or a seventh cross section of the fourth linear shaped charge is canted relative to an eighth cross section of the fourth linear shaped charge, the seventh cross section located at a seventh location on a fourth longitudinal axis of the fourth linear shaped charge and the eighth cross section located at an eighth location on the fourth longitudinal axis.

41. A method according to clause 39 or 40, comprising positioning the third linear shaped charge and the fourth linear shaped charge such that the third longitudinal axis and the fourth longitudinal axis lie in a common plane and an angle between the third longitudinal axis and the fourth longitudinal axis is substantially between 45 degrees and 135 degrees, between 60 to 120 degrees, between 75 to 105 degrees, between 80 to 100 degrees, between 85 to 95 degrees, between 87.5 to 92.5 degrees, substantially 90 degrees within acceptable measuring tolerances, or 90 degrees in the common plane.

42. A method according to any one of clauses 39 to 41, comprising arranging an end face of the third linear shaped charge adjacent to an end face of the fourth linear shaped charge.

43. A method according to clause 42, the detonating the third linear shaped charge and the detonating the fourth linear shaped charge being such that a third wavefront formed by detonating the third linear shaped charge arrives at the end face of the third linear shaped charge substantially simultaneously with a fourth wavefront formed by detonating the fourth linear shaped charge arriving at the end face of the fourth linear shaped charge.

44. A method according to any one of clauses 39 to 43, comprising arranging the first linear shaped charge, the second linear shaped charge, the third linear shaped charge, and the fourth linear shaped charge respectively at a first side, a second side, a third side and a fourth side of a parallelogram.

45. A method according to clause 44, comprising:

arranging a first non-linear shaped charge at a first corner of the parallelogram; and arranging a second non-linear shaped charge at a second corner of the parallelogram, the second corner diagonally opposite the first corner;

such that the first linear shaped charge and the second linear shaped charge abut the first non-linear shaped charge, and the third linear shaped charge and the fourth linear shaped charge abut the second non-linear shaped charge.

46. A method according to clause 45, wherein at least one of:

the first linear shaped charge; or the second linear shaped charge;

comprises an aperture and explosive material with an explosive material surface exposed through the aperture.

47. A method according to clause 45 or 46, comprising:

detonating the first non-linear shaped charge to detonate the first linear shaped charge and the second linear shaped charge; and detonating the second non-linear shaped charge to detonate the third linear shaped charge and the fourth linear shaped charge.

48. A method according to any one of clauses 45 to 48, wherein at least one of:

the first non-linear shaped charge; or the second non-linear shaped charge;

comprises a conical liner or a concave liner.

49. Apparatus substantially as hereinbefore described in the description and/or shown in the drawings.

50. A shaped charge support frame comprising:

a linear shaped charge support structure for supporting a linear shaped charge; and a non-linear shaped charge support structure for supporting a non-linear shaped charge.

Clause Set II

A reference made by a clause within this set to one or more other clauses is to be interpreted as a reference to those clauses within this set of clauses only.

1. A linear shaped charge support structure configured to support a linear shaped charge in a canted configuration with at least part of the linear shaped charge canted about a longitudinal axis of the linear shaped charge.

2. A linear shaped charge support structure according to clause 1, wherein in the canted configuration a first cross section of the linear shaped charge is canted relative to a second cross section of the linear shaped charge, the first cross section located at a first location on the longitudinal axis of the linear shaped charge and the second cross section located at a second location on the longitudinal axis.

3. A linear shaped charge support structure according to clause 1 or 2, wherein the support structure comprises a track for supporting the linear shaped charge along a longitudinal surface of the linear shaped charge.

4. A linear shaped charge support structure according to clause 1 or 2, comprising at least two substantially parallel rails for contacting the linear shaped charge.

5. A linear shaped charge support structure according to clause 3, wherein the track comprises a longitudinal track surface for contacting the longitudinal surface of the linear shaped charge, wherein optionally the longitudinal track surface comprises a slot extending along at least part of a longitudinal axis of the track.

6. A linear shaped charge support structure according to clause 1 or 2, comprising a liner for a linear shaped charge.

7. A support frame comprising:

the linear shaped charge support structure according to any of clauses 1 to 6; and a non-linear shaped charge support structure for supporting a non-linear shaped charge.

8. A support frame according to clause 7, wherein the non-linear shaped charge is selected from a group consisting of a conical charge, an explosively formed penetrator (EFP) charge, and a contact charge.

9. A support frame according to clause 7, wherein the non-linear shaped charge support structure is configured to support a non-linear shaped charge comprising a conical liner or a concave liner.

10. A support frame according to clause 7, the non-linear shaped charge support structure comprising a liner for a non-linear shaped charge.

11. A support frame according to clause 10, the liner having a conical shape or a concave shape.

12. A support frame according to any of clauses 7 to 11, the non-linear shaped charge support structure comprising an aperture and explosive material, with an explosive material surface of the explosive material exposed through the aperture.

13. A support frame according to any of clauses 7 to 12, comprising a second linear shaped charge support structure according to any of clauses 1 to 6.

14. A support frame comprising:

the linear shaped charge support structure according to any one of clauses 1 to 6 and having a first longitudinal axis, the linear shaped charge being a first linear shaped charge, and the linear shaped charge support structure being a first linear shaped charge support structure; and a second linear shaped charge support structure having a second longitudinal axis and configured to support a second linear shaped charge.

15. A support frame according to clause 14, wherein the second linear shaped charge support structure is a linear shaped charge support structure according to any one of clauses 1 to 6.

16. A support frame according to clause 14 or 15, wherein the first longitudinal axis and the second longitudinal axis lie in a common plane and an angle between the first longitudinal axis and the second longitudinal axis is substantially between 45 degrees and 135 degrees, between 60 to 120 degrees, between 75 to 105 degrees, between 80 to 100 degrees, between 85 to 95 degrees, between 87.5 to 92.5 degrees, substantially 90 degrees, or 90 degrees in the common plane.

17. A support frame according to any one of clauses 14 to 16 comprising:

a third linear shaped charge support structure having a third longitudinal axis and configured to support a third linear shaped charge; and a fourth linear shaped charge support structure having a fourth longitudinal axis and configured to support a fourth linear shaped charge.

18. A support frame according to clause 17, wherein:

the third linear shaped charge support structure is a linear shaped charge support structure according to any one of clauses 1 to 6 and the fourth linear shaped charge support structure is a linear shaped charge support structure according to any one of clauses 1 to 6.

19. A support frame according to clause 17 or 18, wherein the first linear shaped charge support structure, the second linear shaped charge support structure, the third linear shaped charge support structure and the fourth linear shaped charge support structure are arranged respectively at a first side, a second side, a third side and a fourth side of a parallelogram.

20. A support frame according to clause 19, comprising a first non-linear shaped charge support structure according to the non-linear shaped charge support structure of any one of clauses 7 to 12, configured to support a first non-linear shaped charge, and arranged at a first corner of the parallelogram.

21. A support frame according to clause 20, comprising a second non-linear shaped charge support structure according to the non-linear shaped charge support structure of any one of clauses 7 to 12, configured to support a second non-linear shaped charge, and arranged at a second corner of the parallelogram, the second corner diagonally opposite the first corner.

22. A support frame according to clause 21, wherein:

the first linear shaped charge support structure and the second linear shaped charge support structure each abut the first non-linear shaped charge support structure; and the third linear shaped charge support structure and the fourth linear shaped charge support structure each abut the second non-linear shaped charge support structure.

23. A support frame comprising:

the linear shaped charge support structure according to any of clauses 1 to 6, the linear shaped charge support structure being a first linear shaped charge support structure, and the linear shaped charge being a first linear shaped charge having a first longitudinal axis; and a second linear shaped charge support structure configured to support a second linear shaped charge having a second longitudinal axis, wherein the first longitudinal axis and the second longitudinal axis lie in a common plane and an angle between the first longitudinal axis and the second longitudinal axis is substantially between 45 degrees and 135 degrees, between 60 to 120 degrees, between 75 to 105 degrees, between 80 to 100 degrees, between 85 to 95 degrees, between 87.5 to 92.5 degrees, substantially 90 degrees within acceptable measuring tolerances, or 90 degrees in the common plane.

24. A support frame according to clause 23, wherein the second linear shaped charge support structure is configured to support the second linear shaped charge in a canted configuration.

25. A support frame according to clause 23, wherein the second linear shaped charge support structure is configured to support the second linear shaped charge in a canted configuration with a third cross section of the second linear shaped charge canted relative to a fourth cross section of the second linear shaped charge, the third cross section located at a third location on the second longitudinal axis and the second cross section located at a fourth location on the second longitudinal axis.

26. A support frame according to any one of clauses 23 to 25, wherein at least one of:

the first linear shaped charge support structure comprises a first linear liner for forming the first linear shaped charge; or the second linear shaped charge support structure comprises a second linear liner for forming the second linear shaped charge.

27. A support frame according to any one of clauses 23 to 26 comprising:

a third linear shaped charge support structure configured to support a third linear shaped charge in a canted configuration with a fifth cross section of the third linear shaped charge canted relative to a sixth cross section of the third linear shaped charge, with the fifth cross section located at a fifth location on a third longitudinal axis of the third linear shaped charge and the sixth cross section located at a sixth location on the third longitudinal axis; and a fourth linear shaped charge support structure configured to support a fourth linear shaped charge in a canted configuration with a seventh cross section of the fourth linear shaped charge canted relative to an eighth cross section of the fourth linear shaped charge, the seventh cross section located at a seventh location on a fourth longitudinal axis of the fourth linear shaped charge and the eighth cross section located at an eighth location on the fourth longitudinal axis.

28. A support frame according to clause 27, wherein the first linear shaped charge support structure, the second linear shaped charge support structure, the third linear shaped charge support structure and the fourth linear shaped charge support structure are arranged respectively at a first side, a second side, a third side and a fourth side of a parallelogram.

29. A support frame according to clause 28, comprising a first non-linear shaped charge support structure, configured to support a first non-linear shaped charge, and located at a first corner of the parallelogram.

30. A support frame according to clause 29, comprising a second non-linear shaped charge support structure, configured to support a second non-linear shaped charge, and located at a second corner of the parallelogram, the second corner located diagonally opposite the first corner.

31. A support frame according to clause 30, wherein at least one of:

the first non-linear shaped charge support structure; or the second non-linear shaped charge support structure;

comprises explosive material and an aperture configured to expose a partial surface of the explosive material.

32. A support frame according to clause 30 or 31, wherein:

the first linear shaped charge support structure and the second linear shaped charge support structure each abut the first non-linear shaped charge support structure; and the third linear shaped charge support structure and the fourth linear shaped charge support structure each abut the second non-linear shaped charge support structure.

33. A support frame according to any one of clauses 27 to 32, wherein at least one of:

the third linear shaped charge support structure comprises a third linear liner for forming the third linear shaped charge;

the fourth linear shaped charge support structure comprises a fourth linear liner for forming the fourth linear shaped charge;

the first non-linear shaped charge support structure comprises a first liner for forming the first non-linear shaped charge; or the second non-linear shaped charge support structure comprises a second liner for forming the second non-linear shaped charge.

34. A linear shaped charge comprising an explosive element and a liner, the linear shaped charge configured in a canted configuration with a first cross section of the linear shaped charge canted relative to a second cross section of the linear shaped charge, the first cross section located at a first location on a longitudinal axis of the linear shaped charge and the second cross section located at a second location on the longitudinal axis.

35. A linear shaped charge according to clause 34, which is a substantially non-flexible linear shaped charge.

36. A linear shaped charge support structure of any of clauses 1 to 6, comprising the linear shaped charge supported in the canted configuration by the linear shaped charge support structure.

What is claimed is:

1. A linear shaped charge support structure comprising:

a first support surface for engagement with a first part of a flexible longitudinal surface of part of a linear shaped charge; and a second support surface for engagement with a second part of the flexible longitudinal surface of part of the linear shaped charge, the first support surface and the second support surface each positioned such that:

with engagement of the first support surface with the first part of the flexible longitudinal surface of part of the linear shaped charge, and with engagement of the second support surface with the second part of the flexible longitudinal surface of part of the linear shaped charge, the first support surface and the second support surface are configured to, in co-operation with each other, hold the linear shaped charge in a canted configuration with:

a first cross section of the linear shaped charge canted relative to a second cross section of the linear shaped charge, the first cross section located at a first location on a longitudinal axis of the linear shaped charge, and the second cross section located at a second location on the longitudinal axis of the linear shaped charge.

2. A linear shaped charge support structure according to claim 1, wherein the support structure comprises a track for supporting the linear shaped charge along the flexible longitudinal surface of the linear shaped charge.

3. A linear shaped charge support structure according to claim 2, wherein at least one of:

the track comprises a longitudinal track surface for contacting the flexible longitudinal surface of the linear shaped charge; or the track comprises a longitudinal track surface for contacting the flexible longitudinal surface of the linear shaped charge, the longitudinal track surface comprising a slot extending along at least part of a longitudinal axis of the track.

4. A linear shaped charge support structure according to claim 1, comprising at least two substantially parallel rails for contacting the linear shaped charge.

5. A linear shaped charge support structure according to claim 1, comprising a liner for a linear shaped charge.

6. A linear shaped charge support structure according to claim 1, comprising the linear shaped charge supported in the canted configuration by the linear shaped charge support structure.

7. The linear shaped charge support structure of claim 1, wherein at least one of:

the first cross section is substantially parallel the second cross section;

the first cross section comprises a first cross section of a liner of the linear shaped charge and the second cross section comprises a second cross section of the liner canted relative to the first cross section of the liner; or the first cross section comprises a first cross section of a flexible liner of the linear shaped charge and the second cross section comprises a second cross section of the flexible liner canted relative to the first cross section of the flexible liner.

* * * * *